US007641050B2

(12) United States Patent
Klatt et al.

(10) Patent No.: US 7,641,050 B2
(45) Date of Patent: Jan. 5, 2010

(54) MEDICINE PACK

(75) Inventors: Andreas Klatt, Stockach (DE); Klaus Hinderegger, Orsingen-Nenzingen (DE)

(73) Assignee: NYCOMED GmbH, Constance (DE)

( * ) Notice: Subject to any disclaimer, the term of this patent is extended or adjusted under 35 U.S.C. 154(b) by 186 days.

(21) Appl. No.: 10/576,092

(22) PCT Filed: Oct. 22, 2004

(86) PCT No.: PCT/EP2004/052634

§ 371 (c)(1),
(2), (4) Date: Apr. 14, 2006

(87) PCT Pub. No.: WO2005/068316

PCT Pub. Date: Jul. 28, 2005

(65) Prior Publication Data

US 2007/0163918 A1 Jul. 19, 2007

(30) Foreign Application Priority Data

Oct. 22, 2003 (DE) ..... 103 49 565

(51) Int. Cl.
*B65D 83/04* (2006.01)

(52) U.S. Cl. ..... 206/535; 206/538

(58) Field of Classification Search ..... 206/531, 206/532, 535, 528, 536, 538, 825
See application file for complete search history.

(56) References Cited

U.S. PATENT DOCUMENTS 2,784,901 A 3/1957 Wilcox
2,801,002 A * 7/1957 Volckening et. al. ..... 206/466
2,921,672 A * 1/1960 Ivy et al. ..... 206/535
3,438,563 A 4/1969 Collura et al.
3,756,385 A 9/1973 Steinbock
3,910,487 A 10/1975 Jaeschke
4,848,582 A * 7/1989 Levasseur et al. ..... 206/534.2
4,889,238 A * 12/1989 Batchelor ..... 206/535
5,169,001 A * 12/1992 Scheibel ..... 206/425
5,219,116 A 6/1993 Hearne (Continued)

FOREIGN PATENT DOCUMENTS

DE 35 13 351 A1 10/1986

(Continued)

OTHER PUBLICATIONS

Fosamax Product Packaging [online] [retrieved on Jun. 9, 2006] Retrieved from the internet <URL:http://www.life-extension-drugs.com/img/products/prod-21.jpg>.

(Continued)

*Primary Examiner*—Jacob K Ackun, Jr.
(74) *Attorney, Agent, or Firm*—The Nath Law Group; Sheldon M. McGee; Derek Richmond

(57) ABSTRACT

The present invention relates to a novel type of medicine pack comprising a plurality of blister units (1), said blister units (1) each having a protective case (6), with a blister strip (4) located therein, the blister strip (4) being fixedly connected to the protective case (6), and the protective case being able to be unfolded or opened out, and also, if appropriate, an outer package (5, 5*a*) for receiving the blister units (1).

11 Claims, 35 Drawing Sheets

U.S. PATENT DOCUMENTS

| | | | | |
|---|---|---|---|---|
| 5,242,055 | A * | 9/1993 | Pora | 206/532 |
| 5,368,187 | A * | 11/1994 | Poncetta et al. | 221/30 |
| 5,913,426 | A | 6/1999 | Lotz Renfro et al. | |
| 6,024,222 | A * | 2/2000 | Friberg et al. | 206/531 |
| 6,273,260 | B1 * | 8/2001 | ColDepietro et al. | 206/532 |
| 6,675,972 | B2 * | 1/2004 | Patterson | 206/531 |
| 7,051,876 | B2 * | 5/2006 | Grosskopf | 206/462 |
| 7,325,689 | B2 * | 2/2008 | Buss | 206/532 |
| 2002/0175106 | A1 | 11/2002 | Nemoto | |
| 2003/0183551 | A1 * | 10/2003 | Hulick | 206/531 |
| 2005/0035023 | A1 * | 2/2005 | Breu et al. | 206/531 |
| 2005/0082194 | A1 * | 4/2005 | Fry et al. | 206/531 |

FOREIGN PATENT DOCUMENTS

| | | | |
|---|---|---|---|
| DE | 44 29 503 | C2 | 2/1996 |
| DE | 197 04 523 | A1 | 8/1998 |
| DE | 297 80 456 | U1 | 7/1999 |
| EP | 0 857 656 | B1 | 8/1998 |
| EP | 0 940 345 | A1 | 9/1999 |
| GB | 2 250 978 | A | 6/1992 |
| GB | 2 366 286 | A | 3/2002 |

OTHER PUBLICATIONS

Fosamax Product Packaging [online] [retrieved on Jun. 9, 2006] Retrieved from the internet <URL:http://www.msd.nl/iimages/195.gif>.

Fosamax Product Packaging [online] [retrieved on Jun. 9, 2006] Retrieved from the internet <URL:http://medcatalog.net/pic/cab/fosamax.jpg>.

Fosamax Product Packaging [online] [retrieved on Jun. 9, 2006] Retrieved from the internet <URL:http://www.edrugdelivery.com/img/products/fosamax.jpg>.

* cited by examiner 8
9
6
1
7
14
11
12
15
3
4
M
10

1
8
11
6
9
12
50
7
2
17
4
18'
4
15

Fig. 14a
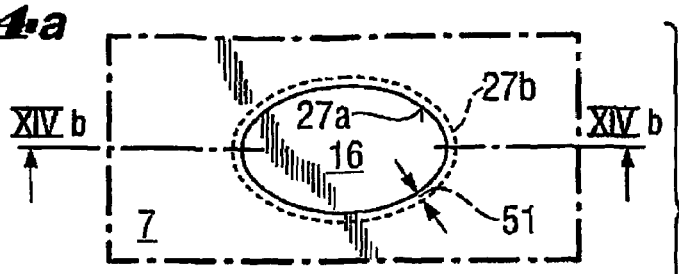
Fig. 14
Fig. 14b
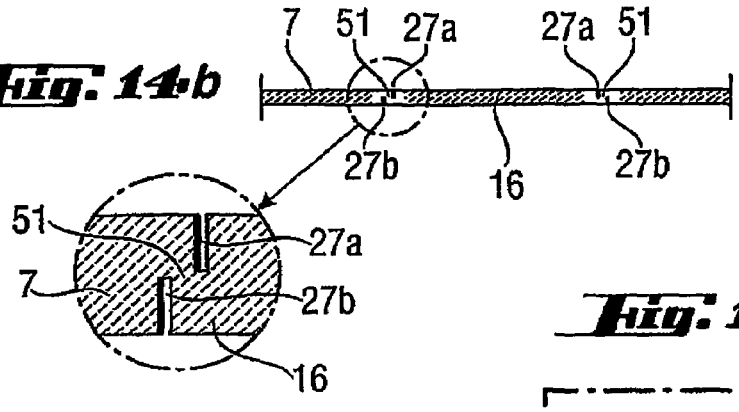
Fig. 15
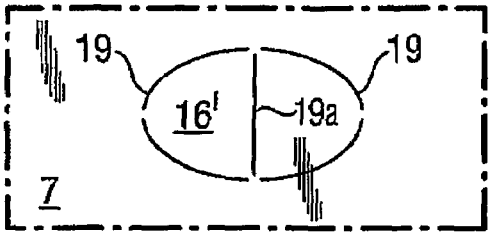
Fig. 16
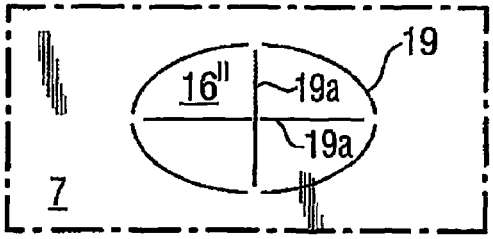
Fig. 17
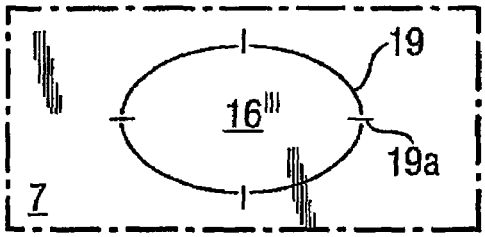
Fig. 18
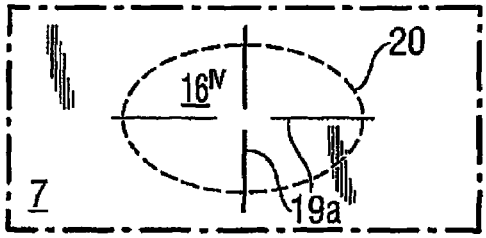
Fig. 19
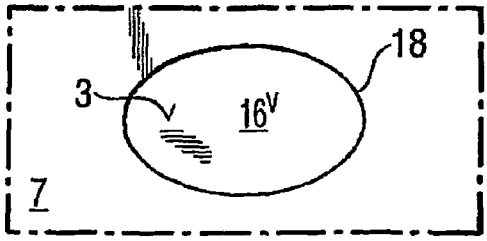

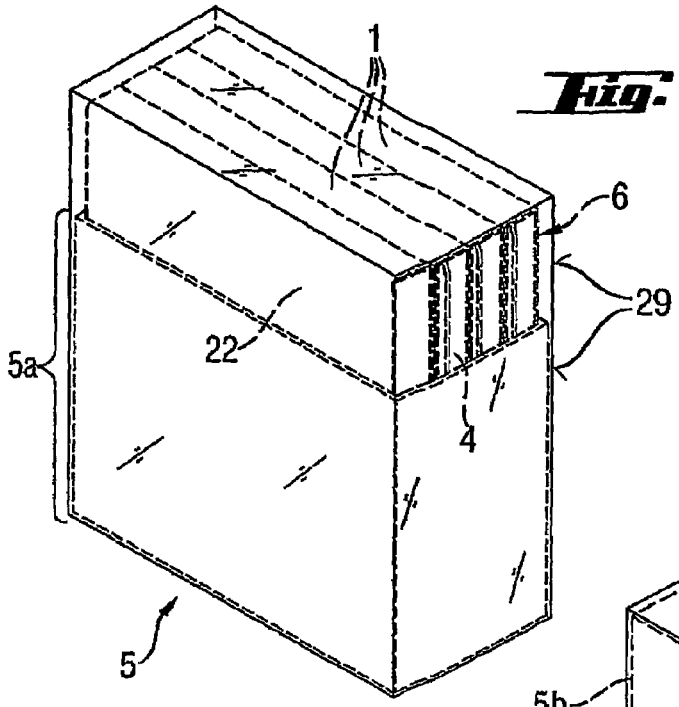
Fig. 29
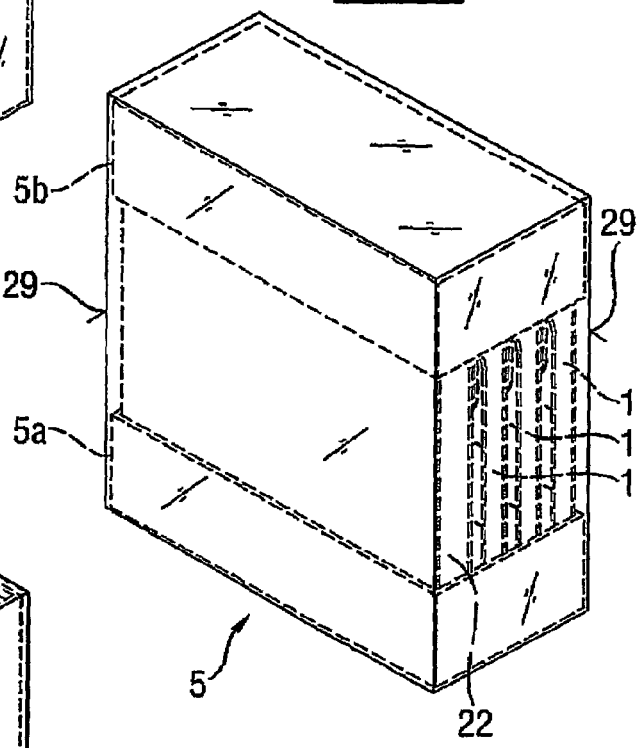
Fig. 30
Fig. 31
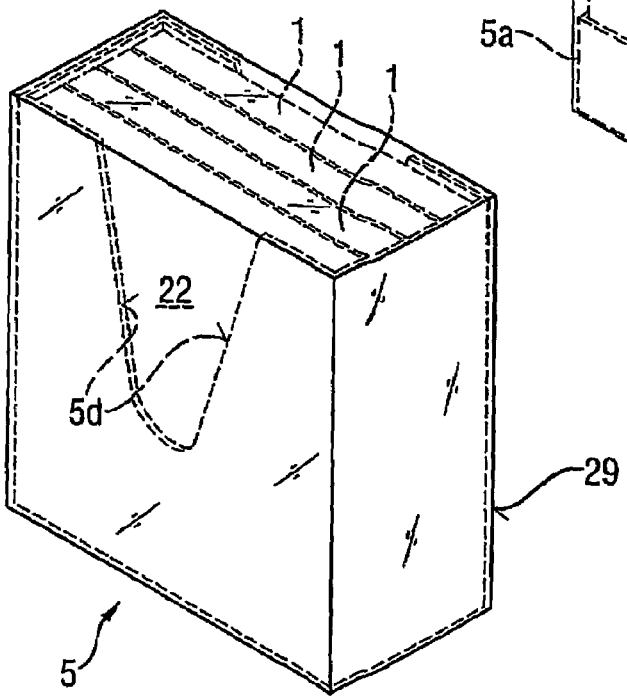

MEDICINE PACK

This application was filed under 35 U.S.C. 371 as a national stage of PCT/EP2004/052634, filed Oct. 22, 2004.

TECHNICAL FIELD

The present invention relates to a novel type of medicine pack in the form of blister strips which contain medicine and which have a protective case. With this pack, the blister strips are protected against inadvertent damage or destruction, and the patient is given the possibility of removing or detaching subquantites of the pack content, and the removed or detached subquantities of the pack content are in turn protected against inadvertent damage or destruction.

PRIOR ART

Blister packs are generally known arrangements for administering medicaments in tablet form or in powder form. The outer package of such blister packs is generally a rectangular box which can be opened at the opposite short narrow ends. This is done by pulling out a tuck-in tab, both tuck-in tabs being produced in one piece with the rest of this box from a common blank. In order to identify the pack content, this box can be printed with the most important patient information, such as name of medicament, logo(s), indication(s), strength, pack size, expiry date, etc., and it is filled with the blister strip or strips and a pack insert containing the necessary detailed information for the patient. The blister strips are normally made up of several layers of different materials. Thus, for example, between two base panels of a suitable material, for example plastic or board, it is possible to insert two further layers of material, of which one forms the blister cavities in which the medicaments lie, and of which the other forms the easily pierced blister base, or a two layer blister structure can be chosen in which the cavities are formed in the upper sheet and the latter is then coated from beneath with a further sheet, the blister base, made of an easily pierced material, as a result of which the cavities in which the medicaments lie are closed.

The usual materials known to the skilled person and used for producing commercially available blister strips are used, for example laminated aluminum foils, PVC (polyvinyl chloride) or PVdC (polyvinylidene chloride) foils or combinations of these, or PP (polypropylene) foils or combinations or laminates of said materials.

The medicament is generally removed from these blister packs by breaking the easily pierced material of the blister base, generally by application of pressure, at the location where the medicament is in contact with the blister base.

If the outer package (box) is separated from the blister strip, for example in order to remove the medicine from a blister strip or to remove a blister strip from the outer package containing several blister strips, and if the blister strip is then not put back into the outer package, for example because the outer package has been lost or discarded, or if only a single blister strip is to be transported instead of all the blister strips contained in the outer package, then the blister strip removed from the outer package and the medicament contained in it are no longer sufficiently protected against damage, for example caused by pressure and impact, during transport. Moreover, when individual blister strips are separated from the outer package, there is no longer sufficient identification as to the nature of the medication, and interactions with other medications cannot be ruled out.

To remedy this shortcoming, various outer packages for blister strips have been described in the prior art, the blister strips and the outer package being connected to one another, thus providing permanent protection for the medicines contained in them.

German patent application DE 4 429 503 describes a compact blister pack with a foldable blister arrangement in which the case, the blister strip or strips and the pack insert form as it were a permanently fixed unit. An adhesive seal which can be repeatedly released permits repeated opening and closing of the case, and at least one tablet or the like can be removed from the blister strip or from one of the blister strips each time. Two blister strips are expediently connected to one another via a web which is adhesively bonded to one of the smaller portions of the blank for the case. After the blister pack has been folded up and closed, the larger portions of the blank for the case cover the blister bases of the blister strips, so that these are protected against inadvertent damage.

International patent application WO 98/00351 describes a compact, foldable blister pack in which a supporting means stabilizes and protects the blister arrangement, especially when the blister arrangement is made of thin and/or flexible material. The blister pack has a blister arrangement composed of a first blister part and a second blister part, each blister part having two parallel rows of blisters. When the blister pack is in the folded state, the blisters engage between one another and form a single blister layer. The blister arrangement is connected to the supporting means, and the supporting means is in turn connected to the protective means (case) so that the entire blister pack forms an interconnected unit.

A disadvantage of these blister packs is that all the blisters or blister strips of the medicine pack are fixedly connected to the outer package and, consequently, it is not possible to remove or detach, from the content of the medicine pack, any subquantities which in turn contain blisters or blister strips which are protected against inadvertent damage. Such removal or detachment of a subquantity with protected blister strips is, however, desirable since in many cases it is more practical to carry around part of the pack content than to carry around the entire medicine pack. Examples of this are when carrying around a daily dose to be taken during the day, or carrying around a dose lasting several days, for example when traveling. A subquantity of the pack content removed or detached in this way could be carried and transported more easily and more discreetly than the entire pack content.

To remedy this shortcoming, various outer packages for blister strips have been described in the prior art, where subquantities of the pack content can be detached or removed, and where the blister strips of these subquantities have a foldable case protecting the blister strip from inadvertent damage.

British patent application GB 2366286 describes a foldable blister pack in the form of a card, the card having a foldable spine element, an adhesive strip located at the edge, and a blister strip secured thereon, so that the card can be folded in such a way that it forms a cover. The card can have a further part on the side facing the adhesive strip, this part being removable along a line of weakening, and, in particular, blister strips can be secured on adjoining series of spine elements or several blister strips can be secured on a single spine element U.S. Pat. No. 5,242,055 describes a pack for provision of individual doses of medication, the pack having a base panel defining a predetermined number of sealed areas. A cover panel for covering the base panel is mounted pivotably on the base panel. Several such packs can for example be stored in a container, and individual packs or groups of more than one pack can be removed one after another from this container.

A disadvantage of these medicine packs, however, is that the optionally provided outer package, for example a box, and the pack content or parts of the pack content can be inadvertently separated from one another after removal or detachment of part of the pack content, for example if part of the pack content slips out or falls out during storage or during transport. For this reason, with these medicine packs it is sometimes not possible to guarantee that the entire pack content or the as yet unused blister strips and the patient information leaflet can be bundled in a compact form for a desired length of time. Therefore, under some circumstances it is not possible to avoid, for example, the patient information leaflet slipping out of the outer package or even being lost before the patient has used up the whole pack content. This important information for the patient is then no longer immediately to hand when needed.

DESCRIPTION OF THE INVENTION

It is therefore an object of the present invention to make available a medicine pack from which subquantities of the pack content in the form of blister units can be removed or detached, and in which the removed or detached blister units are protected against inadvertent damage or destruction.

This object is achieved by a medicine pack, comprising a plurality of blister units, at least two, said blister units each having a protective case, with a blister strip located therein, the blister strip being fixedly connected to the protective case, and the protective case being able to be unfolded or opened out, and also, if appropriate, an outer package for receiving the blister units.

It is a further object of the present invention to make available a medicine pack from which subquantities of the pack content in the form of blister units can be removed or detached and in which the removed or detached blister units are protected against inadvertent destruction or damage and, in addition, the pack content can be stored in an outer package from which the pack content cannot be removed inadvertently.

This object is achieved by a medicine pack, comprising a plurality of blister units, at least two, said blister units each having a protective case, with a blister strip located therein, the blister strip being fixedly connected to the protective case, and the protective case being able to be unfolded or opened out, and also an outer package for receiving the blister units, the outer package being configured in such a way that the pack content can be fixed in the inside of the outer package, so that the pack content cannot be removed inadvertently.

The subject of the invention is therefore a medicine pack, comprising a plurality of blister units, at least two, said blister units each having a protective case, with a blister strip located therein, the blister strip being fixedly connected to the protective case, and the protective case being able to be unfolded or opened out, and also, if appropriate, an outer package for receiving the blister units.

A further subject of the invention is a medicine pack, comprising a plurality of blister units, at least two, said blister units each having a protective case, with a blister strip located therein, the blister strip being fixedly connected to the protective case, and the protective case being able to be unfolded or opened out, and also an outer package for receiving the blister units, the outer package being configured in such a way that the pack content can be fixed in the inside of the outer package, so that the pack content cannot be removed inadvertently.

The medicine pack according to the invention allows the patient to carry around one or more blister units (hereinafter also called blister wallets) containing the required daily dose or a dose lasting several days, and to do so in a simple and discreet manner. The fact that the blister units are smaller compared to conventional medicine packs means, for example, that they can be easily carried in a handbag or in a shirt or jacket pocket. Compared to carrying around individual blister strips from conventional medicine packs, the protective case of the blister unit affords protection for the possibly easily deformable blister strip and can give the blister strip the required shape stability during and after removal of the blister content (medicament). Moreover, compared to just the blister strip on its own, the invention affords the possibility of printing the protective case with the most important patient information such as name of medicament, logo(s), indication(s), strength, pack size, expiry date, etc., and of thus guaranteeing that the patient always has this information available in connection with the blister strip and with the medicament contained in the latter. The optionally present outer package is configured in such a way that the pack content stored in the outer package is fixed in the inside of the outer package, so that it cannot inadvertently be removed from the outer package, although straightforward removal of the pack content or parts of the pack content is still possible. Even when parts of the pack content have been removed from the outer package, the rest of the pack content still remaining in the outer package is fixed in the inside of the outer package. If the pack content is not fixed in the inside of the outer package, stacking of the pack content or of parts of the pack content is not permanently guaranteed. If, for example, the outer package is a box from which the pack content can inadvertently slip out or fall out, then, for example during storage or transport of the medicine pack, it may happen that the pack content or parts of the pack content become detached from the outer package or that the pack content or parts of the pack content are lost.

According to the invention, the protective case is a protective case which protects a blister strip contained in it from inadvertent destruction or damage. Accordingly, a protective case is preferred which is made of a material suitable for affording the blister adequate protection against mechanical actions (for example impacts and pressure during transport), for example cardboard or plastic.

The protective case is preferably designed as a protective case that can be folded out, i.e. the surfaces of the protective case can be folded out at least substantially in one plane, with the blister strip being made accessible in the folded-out state. A protective case that can be folded out accordingly is composed at least of 3 surfaces: rear face, front face and spine, so that, when a protective case is in the folded-up state, with a blister strip secured to it, the rear face covers the blister base and the front face covers the blister surface with the blister cavities, and the spine connects the rear face and the front face of the protective case, the separation lines between spine and rear face and between spine and front face representing the fold lines of the fold-out protective case. In its extent between the fold lines, the spine is preferably configured such that its width corresponds approximately to the height of the blister strip at the locations of the blister cavities. This ensures that the front face and the rear face of the protective case, in the folded-up state, come to lie parallel to one another at the spacing of the width of the spine. In the folded-up form, the protective case can have openings at the sides.

The blank used for the protective case is adapted principally to the dimensions of the blister strip. A substantially rectangular blank is preferred for the protective case. The rear face is preferably rectangular and is dimensioned in such a way that it can cover the entire blister base of the blister strip secured on the protective case. The rear face is preferably larger than the blister strip, so that the blister strip does not protrude beyond the rear face and, when the protective case is closed, the blister strip cannot be readily acted on from the outside. The front face of the protective case can be dimensioned such that, in the folded-up state, the front face is designed to essentially overlap the rear face. The front face of the protective case can, however, also only partially overlap the rear face, e.g. a corner of the front face can be rounded off. However, the front face is preferably dimensioned so that at least the areas of the blister strip having the blister cavities are covered by the front face of the protective case.

If desired, the protective case of the medicine pack according to the invention can be provided with a closure with which the protective case can be closed in the folded-up state. The closure serves to avoid inadvertent opening of the protective case, by connecting the front face and the rear face of the protective case to one another. Examples which may be mentioned are closures which do not permit reclosure and are based on seals or stick-on labels of paper or film (if appropriate also perforated), or closures which permit reclosure and are based on self-adhesive or closing/reclosing labels. In another design, the front face of the protective case can be dosed by means of a tuck-in tab or adhesive spot or the like on the end surface of the protective case or on the rear face of the protective case. According to the invention, the closure is preferably configured so that it can be closed and reopened again as often as needed. Examples of such a closure are a reclosable adhesive strip, velcro strip or adhesion strip or comparably functioning closures.

A variant of the medicine pack according to the invention has a further surface on the protective case, namely an end surface or locking surface. This end surface or locking surface is not connected to the front face, but only to the rear face. The connection of the end surface/locking surface to the rear face is preferably via a fold line which, for example, lies opposite the fold line between rear face and spine, and these two fold lines thus in principle represent parallel lines, or, alternatively however, the fold line between rear face and spine and the fold line between rear face and end surface/locking surface are arranged substantially at right angles to one another.

The blister strip is preferably fixedly connected to the protective case in order to avoid separation of blister strip and protective case and thus guarantee permanent protection of the blister strip. The blister strip can be glued, pinned, welded, sealed or in some other comparable way secured to the protective case. A glued connection between blister strip and protective case is particularly preferred.

In a preferred embodiment of the medicine pack according to the invention, the end surface is connected to the rear face only via a fold line and the blister strip is connected to the protective case in such a way that the blister strip is connected only to the end surface of the protective case and is thus connected to the protective case pivotably about the fold line between rear face and middle face. A connection of the end surface to the blister surface with the blister cavities is preferred. The end surface preferably covers only a part of the blister surface with the blister cavities, preferably only a partial area in which no blister cavities are located. Upon folding-out of this embodiment, the front face is first folded out by folding it along the fold line between front face and spine and the fold line between spine and rear face, by which means the blister strip is made accessible. The blister strip can then be folded away from the rear face by folding the end surface and the attached blister strip along the fold line between the rear face and the end surface. After these folding maneuvers, the blister base no longer lies on the rear face and the blister surface with the blister cavities is freely accessible. By applying pressure to a blister cavity, the medicament contained in it can be pressed through the easily pierced blister base and thus removed from the blister unit.

In a further preferred embodiment of the medicine pack according to the invention, the blister strip is secured on the protective case in such a way that the blister strip is fixedly connected to the rear face of the protective case largely across the entire surface of the blister base, so that the rear face of the protective case covers the blister base permanently and across almost the entire surface. At the locations where the blister cavities come to lie over the rear face of the protective case, the rear face of the protective case in this embodiment is provided with press-through aids for removing a dose of medicament. An advantage of this embodiment is the fixing of the blister base on the rear face of the protective case, by which means the blister is stabilized and the shape of the blister is also maintained after the press-through maneuver.

For additional stabilizing on the blister surface with the blister cavities, the blister strip can optionally be fixedly connected to a locking surface of the protective case and thus be surrounded by the locking surface, so that only the blister cavities are accessible from above. Recesses (e.g. punch holes) of the size of the blister cavities are then preferably present in the locking surface of the protective case at the sites of the blister cavities. The blister strip can be secured via adhesive points to the protective case, e.g. the locking surface can be adhesively bonded to the blister or, if the rear face and the locking surface are larger than the blister strip, these two surfaces can be directly connected to one another, for example adhesively bonded to one another, at the surfaces where they touch, by which means the blister strip is then as it were clamped between the rear face of the protective case and the locking surface.

The press-through aids on the rear face of the protective case are configured in such a way that the rear face of the protective case is provided with press-through aids at the positions where the blister cavities with the medicaments are situated over the rear face.

One possible embodiment of a press-through aid is a simple punch hole as recess in the rear face of the protective case. The blister base is thus no longer covered by the rear face at the sites of the blister cavities.

A further embodiment of a press-through aid consists of a two-sided punch with different widths extending in each case up to half the thickness of the material of the rear face of the protective case. Here, before the first dose of medicament is removed, the entire blister base is covered by the rear face of the protective case. When a dose of medicament is removed in this case, not only the blister base but also the associated punched surface on the rear face of the protective case is pushed through and the medicament can be removed at the rear face of the protective case.

A further embodiment of a press-through aid is a slotted press-through aid made up of one or more slits.

A further possible embodiment of a press-through aid is a perforation on the rear face of the protective case in the shape and dimension of the surface over which the blister cavities are located. If so desired, such perforations can be provided additionally with one or more slits in order to facilitate the press-through maneuver.

The advantage of the embodiments with press-through aids is that the predetermined press-through site facilitates removal of the medicament, since it initially offers a resistance to the press-through maneuver and the tablet is therefore not so easily skewed out of position.

If so desired, in addition to being protected by the protective case, the blister strips can be protected also by an underseal cap. These underseal caps constitute an additional sealing of the blister strips for protecting the medicament from moisture, among other things. The underseal cap ensures the necessary storage stability, when using blister strips made of materials such as PVC or PVdC, during production and during pharmacy storage. The underseal cap is withdrawn by the patient just before the first dose is removed, as a result of which the underseal cap also has the function of a tamperproof closure. When using an underseal cap, the protective case preferably surrounds the blister strip and underseal cap together.

The most important patient information for identifying the pack content, such as name of medicament, logo(s), indication(s), strength, pack size, expiry date, etc., can be printed not just on the outer package but also on the protective case. This printing can be done on all surfaces of the protective case, e.g. inside and/or outside of the rear face and/or front face and/or spine and/or end surface/locking surface of the protective case. In this way it is possible to ensure that the patient at all times has this important information available in conjunction with the blister strip, even when he removes a blister unit from the outer package and keeps it separate from the rest of the pack content.

The blister strips are normally made up of several layers of different materials. Thus, for example, between two base panels of a suitable material, for example plastic or board, it is possible to insert two further layers of material, of which one forms the blister cavities in which the medicaments lie, and of which the other forms the easily pierced blister base, or a two-layer blister strip structure can be chosen in which the cavities are formed in the upper sheet and the latter is then coated from beneath with a further sheet, the blister base, made of an easily pierced material, as a result of which the cavities in which the medicaments lie are closed.

The usual materials known to the skilled person and used for producing commercially available blister strips are used, for example laminated aluminum foils, PVC (polyvinyl chloride) or PVdC (polyvinylidene chloride) foils or combinations of these, or PP (polypropylene) foils or combinations or laminates of said materials.

The blister strip preferably contains a daily quantity of the medicament or a quantity sufficient for several days, in each case consisting of one or more doses of the medicament. The blister strip preferably has 1, 2, 3, 4, 5, 6, 7, 8, 9 or 10, in particular 3, 4, 5, 6 or 7 blister cavities, particularly preferably 5 or 7 blister cavities for receiving a medicament, preferably a tablet or capsule.

A medicine pack according to the invention contains one or more, preferably 1, 2, 3, 4, 5, 6, 7, 8, 9, 10 or more blister units, in particular 2, 3, 4, 5, 6 or 7 blister units, particularly preferably 2, 3, 4, 5 or 6 blister units, and one or more, preferably one leaflet with patient information and directions for use.

Medicine packs according to the invention are preferred in which the total number of the blister cavities included therein for receiving in each case one medicament is 4, 5, 7, 14, 15, 28, 30, 50, 56, 60, 90, 100, 120, 140 or 500.

A particularly preferred example of a medicine pack according to the invention contains 3 or 6 blister units, each blister unit containing one blister strip with 5 blister cavities, and also a leaflet with patient information and directions for use.

A further particularly preferred example of a medicine pack according to the invention contains 2 or 4 blister units, each blister unit containing one blister strip with 7 blister cavities, and also a leaflet with patient information and directions for use.

Since the blister strips according to the present invention are already protected against accidental damage by the protective cases connected to them, the outer package has only a secondary protective function. The object of the outer package is, rather, to bundle together, and maintain in the most compact form possible, the content of the medicine pack or parts thereof, for example after removal of a blister unit. A further object of the outer package can be to secure the pack content against accidentally slipping out or falling out, so that the pack content or parts of the pack content are not unintentionally separated from the outer package. In addition to materials with a mechanical protective function, e.g. cardboard or plastic, the outer package can also be made from materials without a mechanical protective function, such as films, for example cellophane film.

The outer package can either be made of transparent material, for example a transparent film or a transparent box (e.g. folding box), as a result of which the pack content, e.g. the protective cases, can be seen even before the outer package is opened. The outer package, however, can also be made of a nontransparent material, e.g. opaque material, for example cardboard, this making it possible to print the outer package with important information for the patient, for example name of medicament, logo(s), indication(s), strength, pack size, expiry date, etc.

The outer package can also be composed of at least one part made of a transparent material and at least one part made of an opaque material. A preferred example which may be mentioned is an outer package comprising a first outer package which receives the pack content, is made of an opaque material and is configured in such a way that the pack content is fixed in the inside of the outer package, so that the pack content cannot accidentally slip out or fail out, and, additionally, a second outer package which completely encloses the first outer package and is made of a transparent material. In a preferred embodiment of such an outer package composed of a first outer package and of a second outer package, the first outer package consists of a box and the second outer package consists of a transparent film, for example a cellophane film. The transparent film serves to protect the pack content until the first time the pack is opened, and it has to be withdrawn or irreversibly opened to allow the pack content to be removed. The transparent film also has the function of a tamperproof seal. This means that an undamaged transparent film proves that the outer package has not yet been opened, which is of great importance in the sensitive area of patient medication.

Outer packages are therefore particularly preferred in which a transparent film encloses the entire medicine pack. In particular, all outer packages according to the invention, with the pack content held in them, can additionally be enclosed with such a transparent film.

The outer package can also be composed of several individual parts which are not connected to one another, in which case, for example, the above-described purpose of the outer package is achieved only upon interaction of the individual parts. Thus, for example, a first part of the outer package can bundle together the pack content, but cannot by itself avoid the pack content slipping or falling out of this first part of the outer package. A further part of the outer package, by contrast, ensures that the pack content is held together and can no longer slip or fall out of the first part of the outer package. If, for example, the first part of the outer package is composed of an open base box into which the pack content is inserted, then a preferred embodiment of a further part of this outer package consists of a damp sleeve into which the first part of the outer package and the inserted pack content can be pushed. The clamp sleeve consists of at least four surfaces which, in terms of their dimensions, correspond substantially to the dimensions of the pack content to be received. Cardboard may be mentioned as a preferred material for such a damp sleeve.

Preferred embodiments of such damp sleeves consist of at least four surfaces which are fixedly connected to one another and form a hollow space, one or more surfaces being able to be provided with cutouts. Particularly preferred embodiments of such clamp sleeves consist either of 4 surfaces forming a square tube, in which case the first outer package containing the pack content can be pushed into and removed from this clamp sleeve at the opposite ends, or of 5 surfaces forming an open box, in which case the first outer package containing the pack content can pushed into this damp sleeve preferably via the open side of the damp sleeve and can be removed from this clamp sleeve. An outer package assembled in this way can additionally be enclosed by a further outer package, for example a transparent film, as has already been described above.

The outer package can be such that it is not reclosable, or the outer package or part of the assembled outer package, if permitted by the embodiment, can also be reclosed with the aid of a device for closing the outer package.

In a preferred embodiment of a reclosable outer package, the outer package is composed of a box with a reclosable hinged lid or a reclosable hinged sleeve. The hinged lid or hinged sleeve can here be closed in a number of ways, the possible closure mechanisms being familiar to the skilled person in this field. Examples which may be mentioned here are those closure mechanisms based on sticking or adhesion effects or those mechanisms which, via insert connections, for example tabs on the hinged sleeve or on the hinged lid inserted into slits on the relevant wall of the box or in a comparable way, permit a reversible connection of the hinged lid or of the hinged sleeve to the box. A particularly preferred embodiment for a reclosable outer package is a box, for example of the kind described in patent specification CH 534616 and in European patent application EP 059978. Here, one opening edge of the cardboard box is provided with a locking tongue which, under the inherent elasticity of the connection site with the adjacent box side, protrudes outward. Connecting tabs on the hinged lid form shoulders behind which the locking tongue engages, when the hinged lid is closed, and secures the hinged lid in the closed position. To open the hinged lid, the latter is simply lifted until the locking tongue disengages from the shoulders and releases the lid.

In a further preferred embodiment of a reclosable outer package, the outer package is composed of a base box with a sealing strap. The sealing strap is preferably fixedly connected to the rear face of the base box, for example via a common edge, and serves for closing the outer package and thus for protection during transport and storage. The sealing strap consists at least of two surfaces: a first surface which is connected to the rear face of the base box completely or partially covers the top face of the pack content, and a further surface is used to completely or partially cover the front face of the pack content and to connect the sealing strap to the base box by reversible application to the latter, and thus dose the outer package. With the outer package closed, the sealing strap ensures that the pack content cannot fall out or slip out from the base box open at the top. A large number of designs are conceivable for the sealing strap, these designs differing, for example, in terms of how this sealing strap for closure of the outer package is connected to the base box, and in terms of the surface area dimensions of the sealing strap. The sealing strap is preferably produced together with the base box from one piece and from the same material as the base box, preferably cardboard.

A preferred embodiment of an outer package with sealing strap is a tuck-in sealing strap which is dosed by folding the tuck-in sealing strap over the pack content and inserting the end of the tuck-in sealing strap not connected to the rear face of the base box, or inserting a tab on the tuck-in sealing strap, into a slit which is provided for this purpose and is preferably located on the front face of the base box or in the bottom of the base box.

A further preferred embodiment of an outer package with sealing strap is a sealing strap which can be connected to the outer package via a contact point, for example a stick-on point, an adhesion point, a velcro point, or in a comparable way, the contact point being designed in such a way that repeated opening and closing of the outer package is possible.

In a particular embodiment of an outer package, the above-described device for closing the outer package (hinged sleeve, hinged lid or sealing strap) is connected to the outer package in such a way that the hinged sleeve, the hinged lid or the sealing strap can be easily detached from the rest of the outer package. For example, the hinged sleeve, the hinged lid or the sealing strap can be connected to the outer package via a perforation, along which the hinged sleeve, the hinged lid or the sealing strap can be detached from the rest of the outer package.

In a preferred embodiment of the outer package, the outer package includes a means for retention of the pack content, which means is such that it allows the parts of the pack content held in the outer package (blister units and the leaflet with the patient information and directions for use) to interact with the outer package in such a way that the parts of the pack content can be easily removed when required, but otherwise, for example during transport or storage, cannot fall or slip out of the outer package, even in the absence of the hinged lid, sealing strap or similarly acting device.

A preferred embodiment of such a retention means are resilient tabs which are connected resiliently to the outer package at opposite sides on the inside of the outer package. A permanent connection of the resilient tabs to the outer package is preferred, for example by the outer package and the resilient tabs being made from a single punched blank or the resilient tabs being permanently connected to the outer package by adhesive bonding, welding, sealing or in a similar way. In a preferred embodiment, the resilient tabs are in each case permanently connected to the outer package via at least one common bend/fold edge, each of these bend/fold edges preferably being an edge at the opening of the outer package.

In a particularly preferred embodiment, the resilient tabs come into contact with the narrow sides of the blister units and of the leaflet, since all parts of the pack content are then protected against accidentally failing out or slipping out of the outer package, for example even irrespective of how many blister units are located in the outer package. The resilient tabs are therefore preferably fixed on the side walls of the outer package. If, for example, the content of a blister unit is used up and the latter is not placed back in the outer package, the remaining parts of the pack content are also protected against accidentally falling out or slipping out of the outer package. When a blister unit or the leaflet is inserted into the outer package, this is done counter to the resistance of the resilient tabs which, although they yield resiliently, nevertheless apply pressure from opposite sides onto the narrow sides of the blister unit or leaflet and clamp these in the inside of the outer package. The friction which arises between the resilient tabs and the blister units and leaflet fixes the pack content in the inside of the outer package and thus ensures that the pack content cannot slip or fall too easily and thus accidentally out of the package.

In one embodiment to which emphasis is attached, the resilient tabs are configured in such a way that, on the one hand, they are connected to the respective side wall at the opening of the box, for example via a common bend/fold edge, and, on the other hand, are connected to the side wall at the bottom of the box. The connection of the resilient tab to the bottom of the box can, for example, be effected by the resilient tab being glued or riveted to the bottom of the box, or the end of the resilient tab being connected to the bottom via a plug-type attachment or in a comparable manner. In this embodiment, the resilient tab is of such dimensions that it forms a curved, tensioned surface in the inside of the box between the opening of the box and the bottom of the box, and a dome-shaped hollow space is obtained between the side wall and the resilient tab. The tensioning in such a resilient tab can be varied, depending on requirements, by difference in length between side wall and resilient tab. The longer the resilient tab compared to the side wall, the larger the hollow space between them and the greater the tensioning of the resilient tab.

In a further embodiment to which emphasis is attached, the resilient tabs are configured in such a way that they are connected to the respective side wall at the opening of the box, for example via a common bend/fold edge, and the resilient tabs, at the end remote from this bend/fold edge, are provided with a resilient tab extension. The resilient tab extension is preferably connected to the resilient tab via a common edge, for example via a fold line. Resilient tab extension and resilient tab are preferably made from one piece. The resilient tab extension is bent away from the resilient tab and about the fold line in such a way that the resilient tab extension comes to lie between the resilient tab and the side wall. The inherent elasticity of the fold line has the effect that the resilient tab extension protrudes away from the resilient tab in the direction of the side wall and thus resiliently braces the resilient tab from the side wall.

In a further embodiment to which emphasis is attached, the resilient tabs are designed as short resilient tabs such that said short resilient tabs are connected only to the respective side wall at the opening of the box, for example via a bend/fold edge. The inherent elasticity of the bend/fold edge between short resilient tab and side wall has the effect that the short resilient tab protrudes from the side wall and, in this way, the short resilient tab is braced resiliently from the side wall. By suitable choice of the material of the short resilient tab, for example cardboard, and, if appropriate, suitable choice of the fiber direction of the material and suitable choice of the dimension, in particular length, of the short resilient tabs, the skilled person in this field can, with this simple construction, achieve a correct retention effect.

In one such embodiment of a short resilient tab, the retention effect of the short resilient tabs can be further strengthened by suitable additional measures, for example by providing the blister units with one or more notches. This notch or these notches is/are applied on the blister unit in such a way that the resilient tab or tabs engages/engage into this notch or these notches of the blister unit as soon as the blister unit is fitted completely into the box. The resilient tab or tabs engaged in the notch or notches has/have the function of barbs, by which means the blister units are locked in a defined position in the inside of the box. The removal of a blister unit is permitted by the fact that, when sufficient pull is applied to a blister unit in the direction of the opening of the box, the resilient tab or tabs snap back out of the notch or notches and the blister units can thus be easily removed.

In a further embodiment to which emphasis is attached, the resilient tabs are designed such that they are connected to the respective side wall at the opening of the box, for example via a common bend/fold edge, and the resilient tabs, at the end remote from this bend/fold edge, are provided with a resilient tab extension. The resilient tab extension is preferably connected to the resilient tab via a common edge, for example via a fold line. Resilient tab extension and resilient tab are preferably made from one piece. The resilient tab extension is bent away from the resilient tab and about the fold line in such a way that the resilient tab extension comes to lie between the resilient tab and the side wall. The inherent elasticity of the bent fold line has the effect that the resilient tab extension protrudes away from the resilient tab in the direction of the side wall and thus resiliently braces the resilient tab from the side wall.

A preferred embodiment of an outer package according to the invention includes a box equipped with resilient tabs.

A preferred outer package according to the invention comprises a base box which is provided with one of the above-described devices for fixing the pack content or parts of the pack content in the inside of the base box, the base box being lower than the pack content, and if appropriate a transparent film as wrapper, so that the content of the outer package can be seen even before the outer package is removed or opened. This, for example, allows a pharmacist or patent to identify the pack content without opening the outer package.

A particularly preferred embodiment of an outer package includes an above-described base box which is equipped with resilient tabs in the inside of the base box.

An embodiment of an outer package to which emphasis is attached comprises an above-described base box, which is equipped with resilient tabs in the inside of the base box, and a transparent film as wrapper.

A further particularly preferred embodiment of an outer package comprises an above-described base box with a device for reclosing the outer package, for example with a reclosable hinged lid, a hinged sleeve or a sealing strap.

A further embodiment of an outer package to which emphasis is attached comprises an above-described base box with a device for reclosing the outer package, for example with a reclosable hinged lid, a hinged sleeve or a sealing strap, and a transparent film as wrapper.

A further particularly preferred embodiment of an outer package comprises an above-described base box with a device for reclosing the outer package, for example with a reclosable hinged lid, a hinged sleeve or a sealing strap, and which is equipped with resilient tabs in the inside of the base box.

A further embodiment of an outer package to which emphasis is attached comprises an above-described base box with a device for reclosing the outer package, for example with a reclosable hinged lid, a hinged sleeve or a sealing strap, and which is equipped with resilient tabs in the inside of the base box, and a transparent film as wrapper.

A further particularly preferred embodiment of an outer package comprises an above-described base box with a device for reclosing the outer package, for example with a reclosable hinged lid, a hinged sleeve or a sealing strap, whereby the hinged sleeve, the hinged lid or the sealing strap can be detached from the rest of the outer package.

A further embodiment of an outer package to which emphasis is attached comprises an above-described base box with a device for reclosing the outer package, for example with a reclosable hinged lid, a hinged sleeve or a sealing strap, whereby the hinged sleeve, the hinged lid or the sealing strap can be detached from the rest of the outer package, and a transparent film as wrapper.

A further particularly preferred embodiment of an outer package comprises an above-described base box with a device for reclosing the outer package, for example with a reclosable hinged lid, a hinged sleeve or a sealing strap, whereby the hinged sleeve, the hinged lid or the sealing strap can be detached from the rest of the outer package, and which is equipped with resilient tabs in the inside of the base box.

A further embodiment of an outer package to which emphasis is attached comprises an above-described base box with a device for reclosing the outer package, for example with a reclosable hinged lid, a hinged sleeve or a sealing strap, whereby the hinged sleeve, the hinged lid or the sealing strap can be detached from the rest of the outer package, and which is equipped with resilient tabs in the inside of the base box, and a transparent film as wrapper.

A preferred embodiment (embodiment A) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a device for reclosing the outer package.

A further preferred embodiment (embodiment B) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a device for reclosing the outer package, and a film as wrapper.

A further preferred embodiment (embodiment C) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs.

A further preferred embodiment (embodiment D) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs and a film as wrapper.

A further preferred embodiment (embodiment E) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs and a device for reclosing the outer package.

A further preferred embodiment (embodiment F) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs, a device for reclosing the outer package, and a film as wrapper.

A preferred embodiment (embodiment G) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a device for reclosing the outer package, whereby the device for reclosing can be detached from the rest of the outer package.

A further preferred embodiment (embodiment H) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a device for reclosing the outer package, which can be detached from the rest of the outer package, and a film as wrapper.

A further preferred embodiment (embodiment I) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs and a device for reclosing the outer package, whereby the device for reclosing can be detached from the rest of the outer package.

A further preferred embodiment (embodiment J) of the medicine pack according to the invention comprises a plurality of blister units, said blister units each having a protective case, with a blister strip located therein, the blister strip being fixedly connected to the protective case, and the protective case being able to be unfolded or opened out, and also an outer package for receiving the blister units, the outer package having a base box with resilient tabs, a device for reclosing the outer package, which can be detached from the rest of the outer package, and a film as wrapper.

In one particular embodiment, the individual blister units, for example 3 blister units, located in the outer package are not interconnected so that, after opening or removal of the outer package, individual blister units can be removed one after another from the outer package.

In a further particular embodiment of the invention, a plurality of blister units, for example 3 blister units, can be interconnected to form a group of blister units (if appropriate separable). An optionally present outer package can contain one or more, preferably one, two or three, in particular one group of blister units. In this embodiment, however, the connection between the individual blister units is such that individual blister units can be easily detached one after another from the remaining blister units. To do so, one group of blister units is first removed from the optionally present outer package, and then an individual blister unit is detached. Groups of blister units are preferred in which the interconnected blister units can be folded together to form a compact shape. Groups of blister units are particularly preferred in which the interconnected blister units can be folded together in the manner of a concertina, so that, in the folded state, the individual blister units are coplanar with respect to one another, and, thus, the two-dimensional extent of the folded group of blister units substantially corresponds to the two-dimensional extent of an individual blister unit.

The connection between the individual blister units can, for example, consist of a common edge of the protective cases of two interconnected blister units (e.g. if a common punch form has been used for the blister units). To facilitate the detachment of an individual blister unit, the connection between two blister units can be equipped with a detachment aid. Such a detachment aid is, for example, a perforation in the common edge of the protective cases of two interconnected blister units. If so desired, however, individual blister units can also be connected detachably to one another, for example by paper or film adhesive labels at the sides. Blister units whose structure is based on a common punch form have the advantage, for example, of economic production and elimination of waste in the blank. The common punch form of the protective cases can first be produced, then the blisters are applied, the untrimmed sheet is suitably folded and, if desired, inserted with a patient leaflet into a suitable outer package.

After detachment of an individual blister unit from a group of blister units, the remaining blister units can be folded together again into a compact shape, the group of blister units then consisting of one less blister unit than before the detachment of a blister unit.

Examples of medicine packs according to the present invention are described below. The following examples explain the invention in more detail, but without limiting it in particular, the examples are not limited to the cited number of blister cavities per blister unit or to the number of blister units per outer package. In the examples, all the examples of blister units can be combined with all the examples of outer packages. Likewise, all the examples of press-through aids can be combined with all the examples of blister units. In addition, all the examples of blister units can be combined according to the invention to form a group of blister units.

FIGS. 1 through 13 show various embodiments and views of blister units.

FIGS. 14*a* through 19 show various embodiments of press-through aids.

FIGS. 25 through 45 show various embodiments of outer packages, the outer packages illustrated each containing, for example, three blister units and the leaflet with the patient information and directions for use.

FIGS. 46 through 54 show various embodiments and views of base boxes, said base boxes being equipped with resilient tabs.

The blister units shown in FIGS. 1 through 13 and FIGS. 20 through 24 all have a blister strip with five blister cavities. These views thus show a preferred embodiment of the blister units, but without the invention being limited to this particular embodiment.

Figure 1:
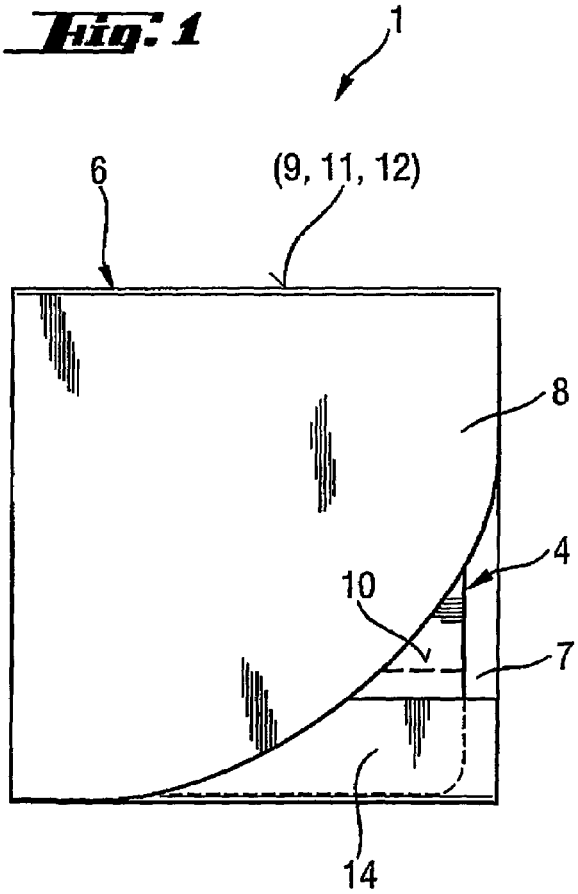

FIG. 1 shows a closed blister unit 1 composed of a protective case 6 and of a blister strip 4. The front face 8, the rear face 7 and the spine 9 of the protective case 6 can, if desired, be printed with the most important patient information. In this particularly preferred example, the right corner of the front face 8 of the protective case 6 is also rounded off, so that the front face 8 is designed to only partially overlap the rear face 7 of the protective case 6. Also in this particular example, the front face 8 does not completely cover the blister strip 4, but basically only the areas of the blister cavities 2. The protective case 6 of the illustrated blister unit 1 is provided with an end surface 14 which is likewise only partially covered by the front face 8.

Figure 2:
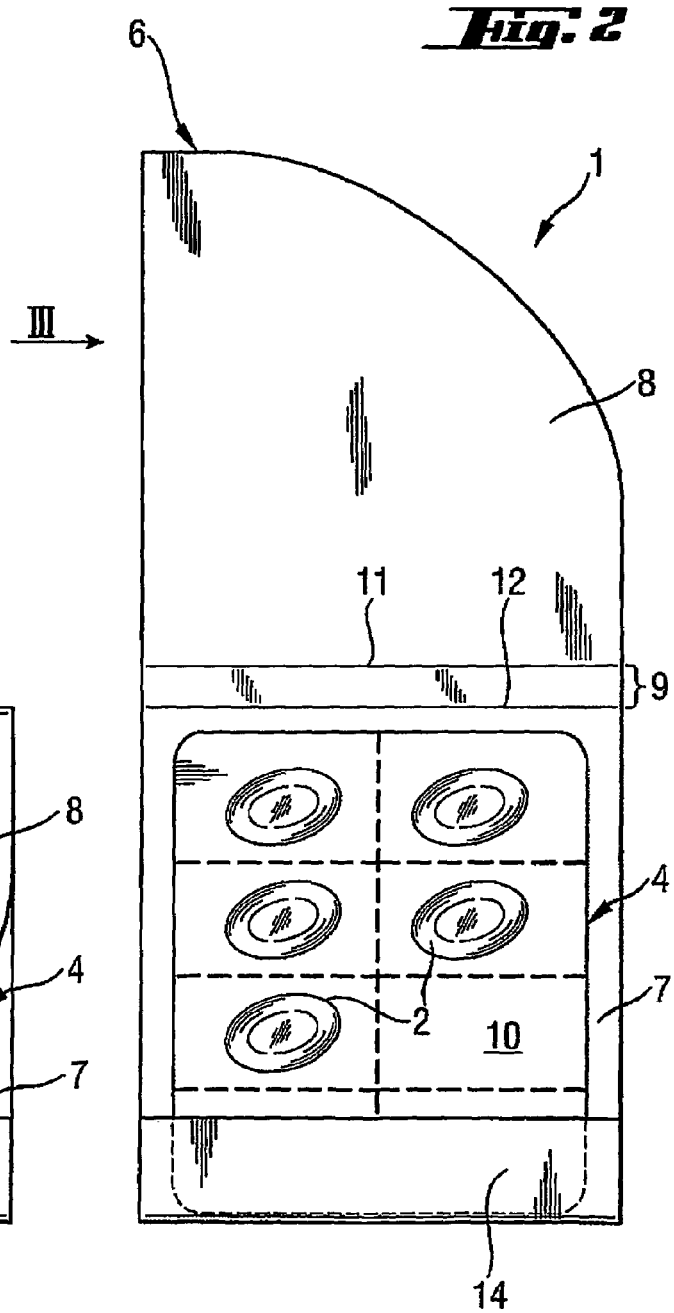

FIG. 2 shows the inside view of a blister unit 1 according to the invention from FIG. 1, where the front face 8 of the protective case 6 has been folded out. As a result of this folding-out, the entire blister surface 10 of the blister strip 4 with the blister cavities 2 is visible, and also the spine 9, the fold line 11 between spine 9 and front face 8, and the fold line 12 between spine 9 and rear face 7, and the entire end surface 14. In this particular embodiment, the blister strip 4 is slightly smaller in area than the rear face 7 of the protective case 6.

Figure 3:
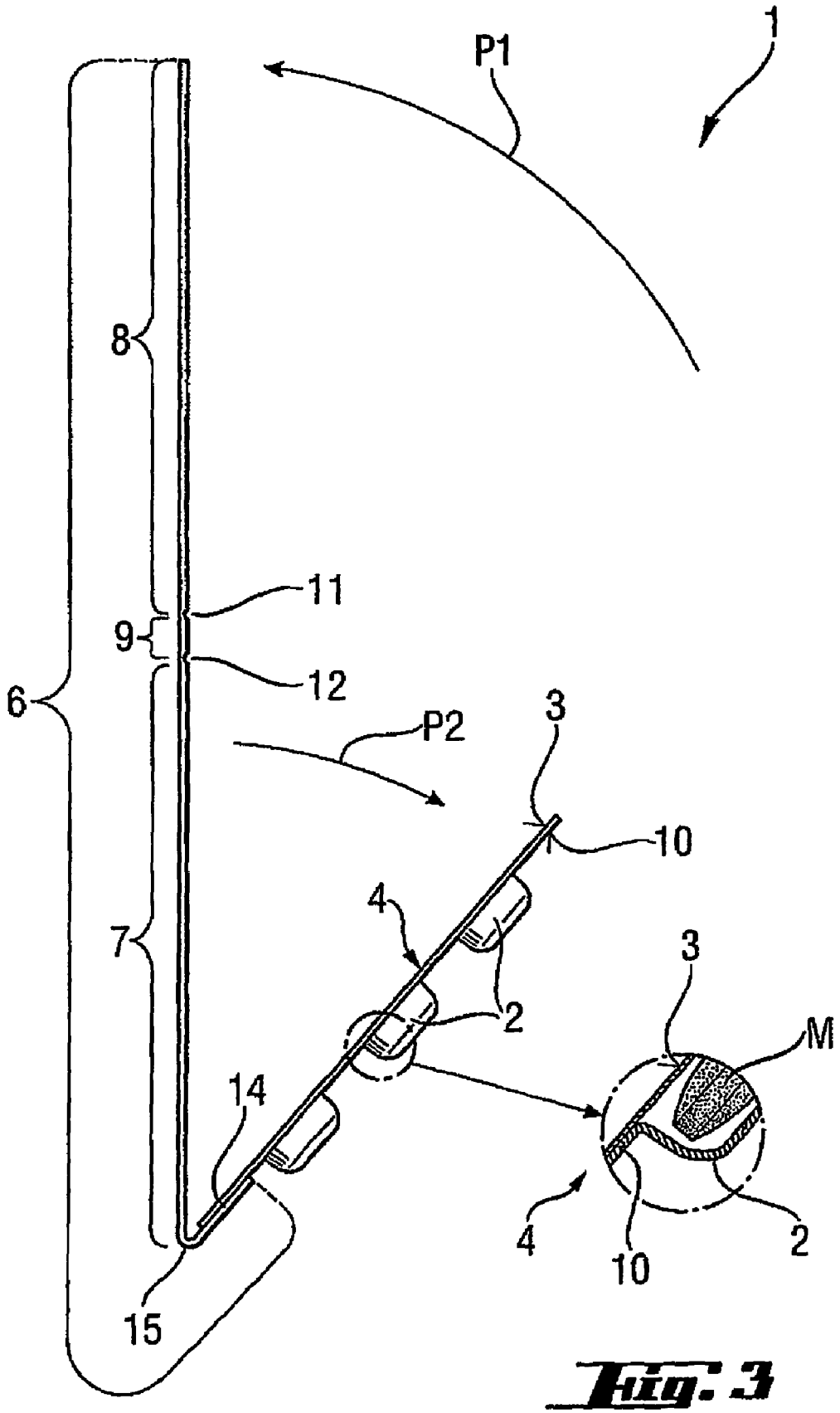

FIG. 3 shows the side view from direction III and an enlarged cross-sectional detail of a blister unit 1 according to the invention from FIG. 2, in which the blister strip 4 is connected to the protective case 6 in such a way that the blister strip 4 is connected only to the end surface 14 of the protective case 6 and is thus connected to said protective case 6 pivotably about the fold line 15. After the front face 8 has been folded out in the direction of arrow P1, as shown in FIG. 2, the blister strip 4 can thus be folded away from the rear face 7. In the direction of arrow P2, so that the blister base 3 is no longer covered by the rear face 7. In this folded-out state of the protective case 6, the medicament M can be removed from the blister strip 4. By applying pressure to a blister cavity 2, the medicament M located in it can be pressed through the easily pierced blister base 3 and thus removed from the blister unit 1 between the blister base 3 and the rear face 7.

Figure 4:
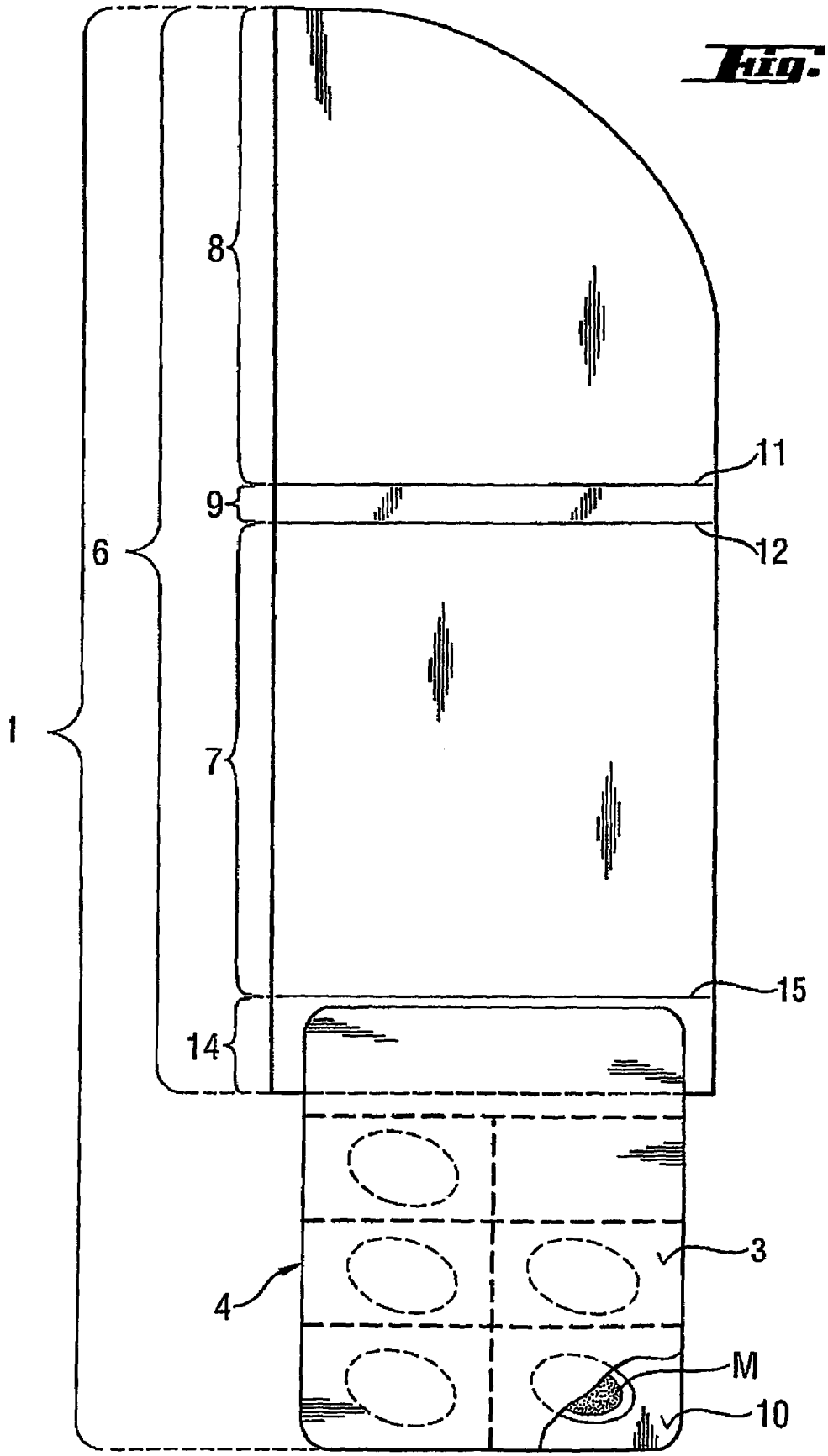

FIG. 4 shows the blister unit 1, illustrated in FIG. 2, in which the blister strip 4 has been folded completely around the fold line 15 between rear face 7 and end surface 14. It is now possible to see the blister base 3 of the blister strip 4, and also where the blister strip 4 is fixedly connected to the end surface 14, for example by adhesive bonding or welding.

Figure 5:
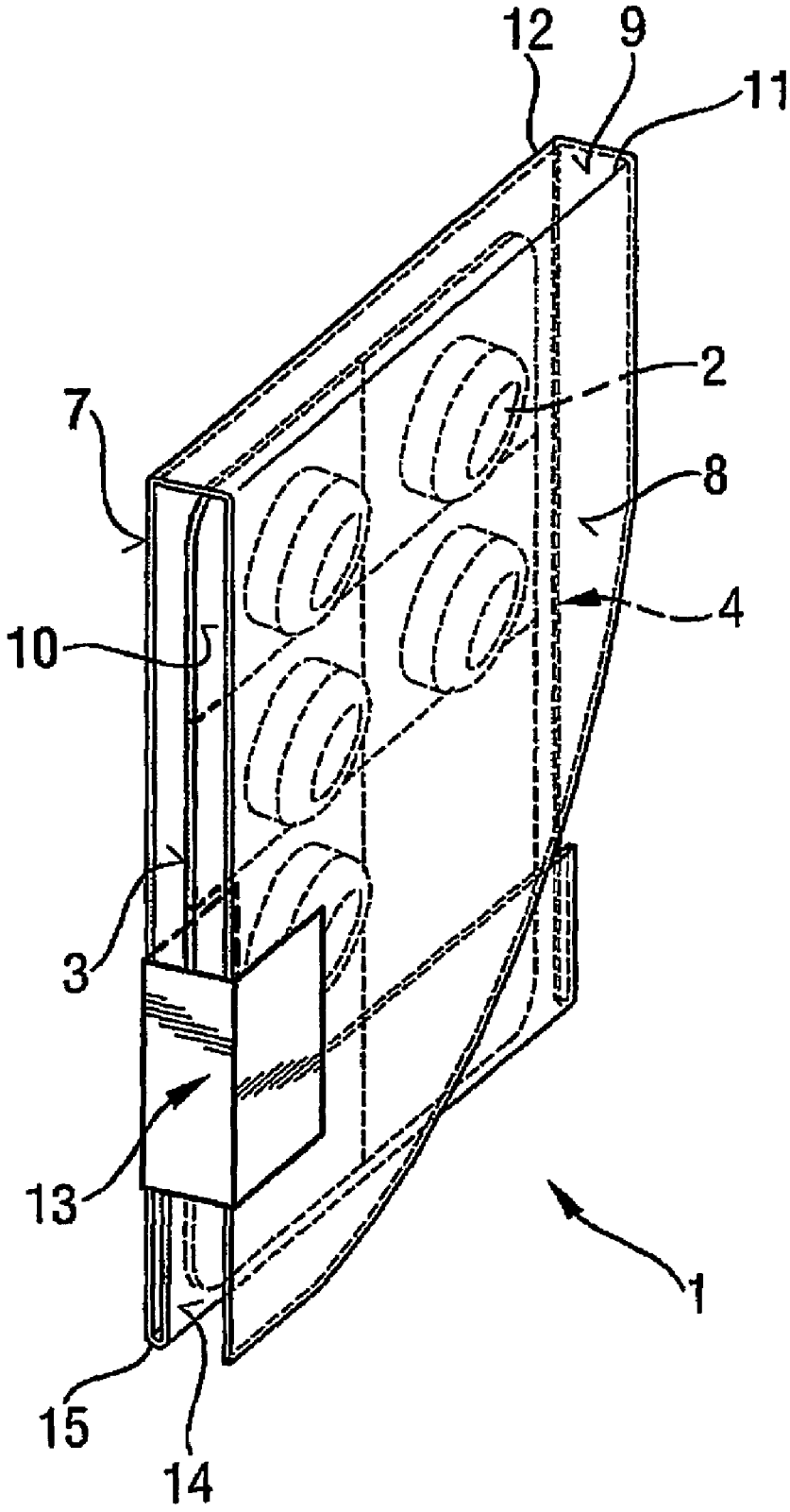

FIG. 5 shows a closed blister unit 1 in which the rear face 7 is connected to the front face 8 via a closure 13, and the protective case 6 thus cannot be opened out in this state. Only after release of the closure 13 can the protective case 6 be folded out.

Figure 6:
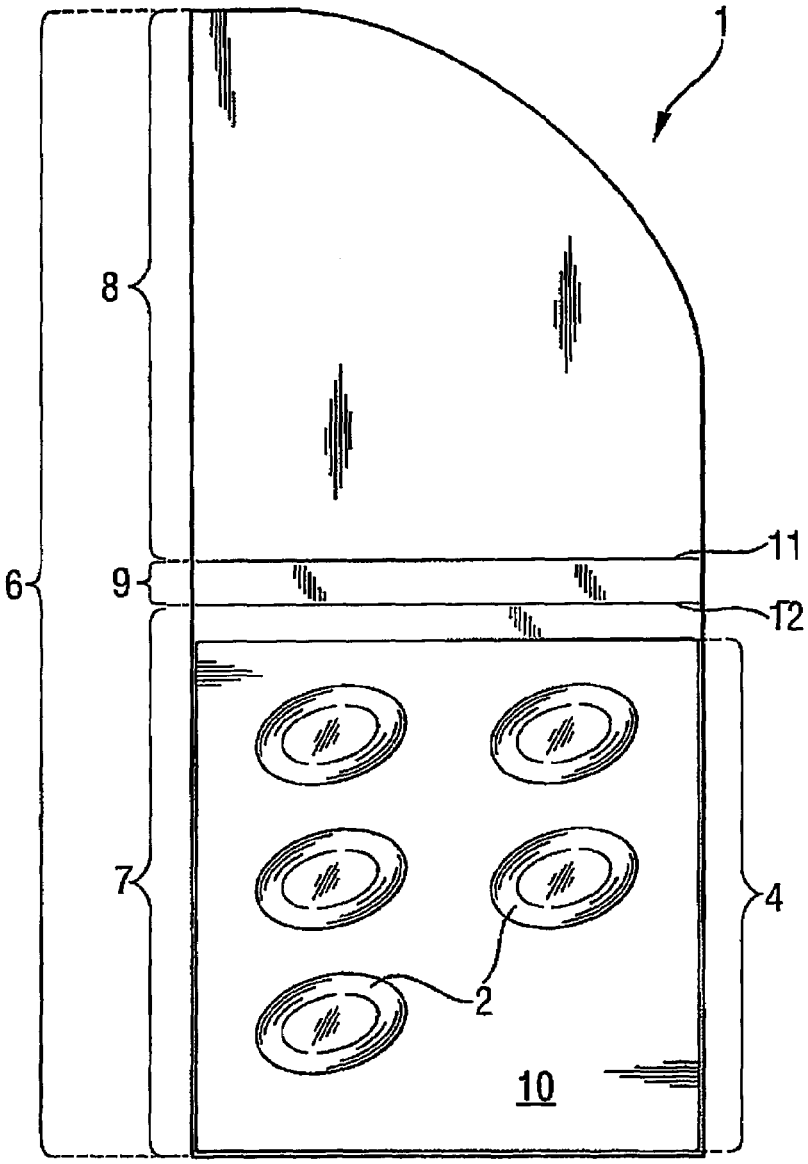
Figure 7:
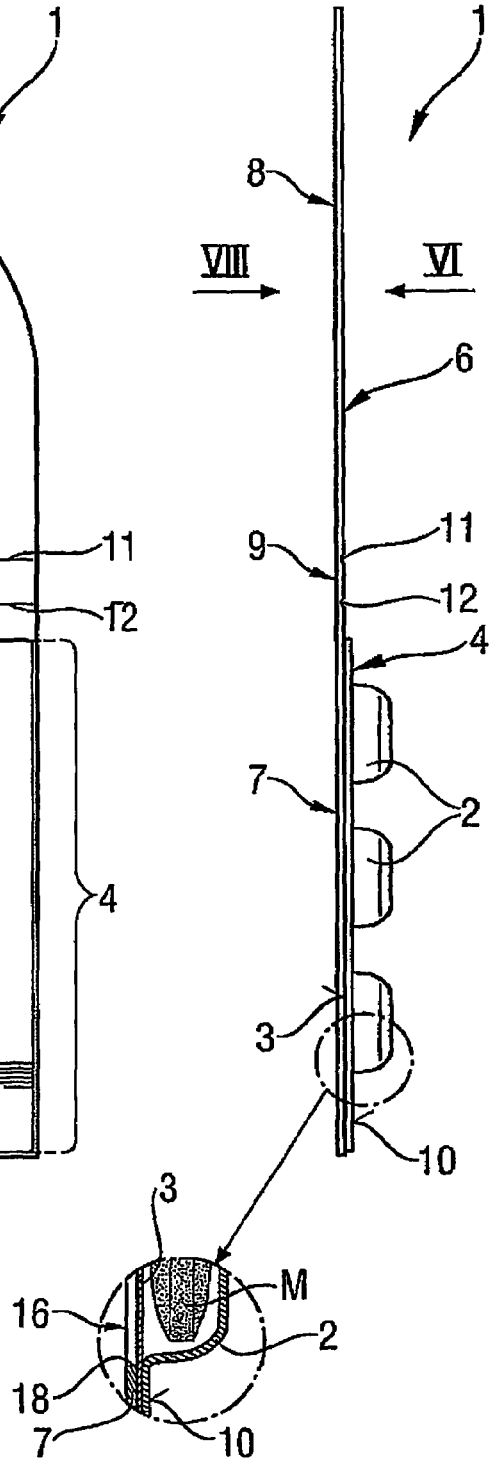

FIG. 6 shows the inside view of a blister unit 1 according to the invention seen from direction VI in FIG. 7, in which the front face 8 has been folded out, in the same way as in FIG. 2, but without end surface 14. In this particular example, the blister strip 4 is only slightly smaller in area than the rear face 7 of the protective case 6.

FIG. 7 shows the side view and an enlarged cross-sectional detail view of a blister unit 1 according to the invention from FIG. 6. It can be seen that the blister strip 4 is fixedly connected largely across the entire surface of the blister base 3 to the rear face 7 of the protective case 6 and so, in contrast to FIG. 3, the blister strip 4 is not by itself connected pivotably to the protective case 6.

Figure 8:
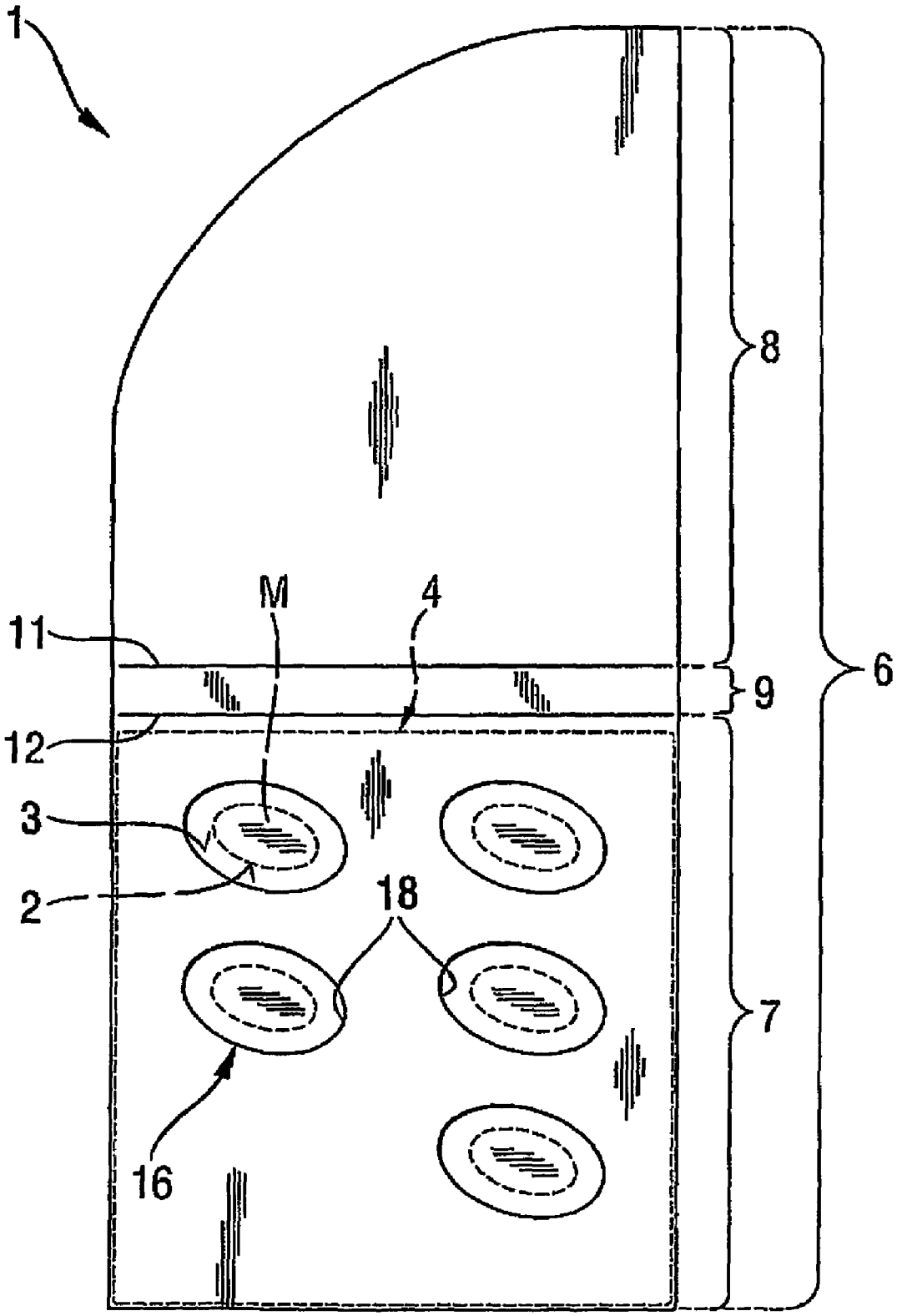

FIG. 8 shows the outside view, seen from direction VIII in FIG. 7, of a blister unit 1 according to the invention from FIG. 6 and FIG. 7, in which the front face 8 has been folded out. Since the blister strip 4 shown by broken lines is fixedly connected largely across the entire surface of the blister base 3 to the rear face 7 of the protective case 6, the rear face 7 of the protective case 6 is equipped with press-through aids 16 in the form of punch holes 18 for removal of the medicaments M. By applying pressure to a blister cavity 2, the medicament M contained in it can be pressed through the easily pierced blister base 3 and the press-through aid 16, here specifically the punch hole 18. Thus, the medicament M can be removed from the blister unit 1 at the rear face 7 (see also FIG. 7, enlarged cross-sectional detail).

Figure 9:
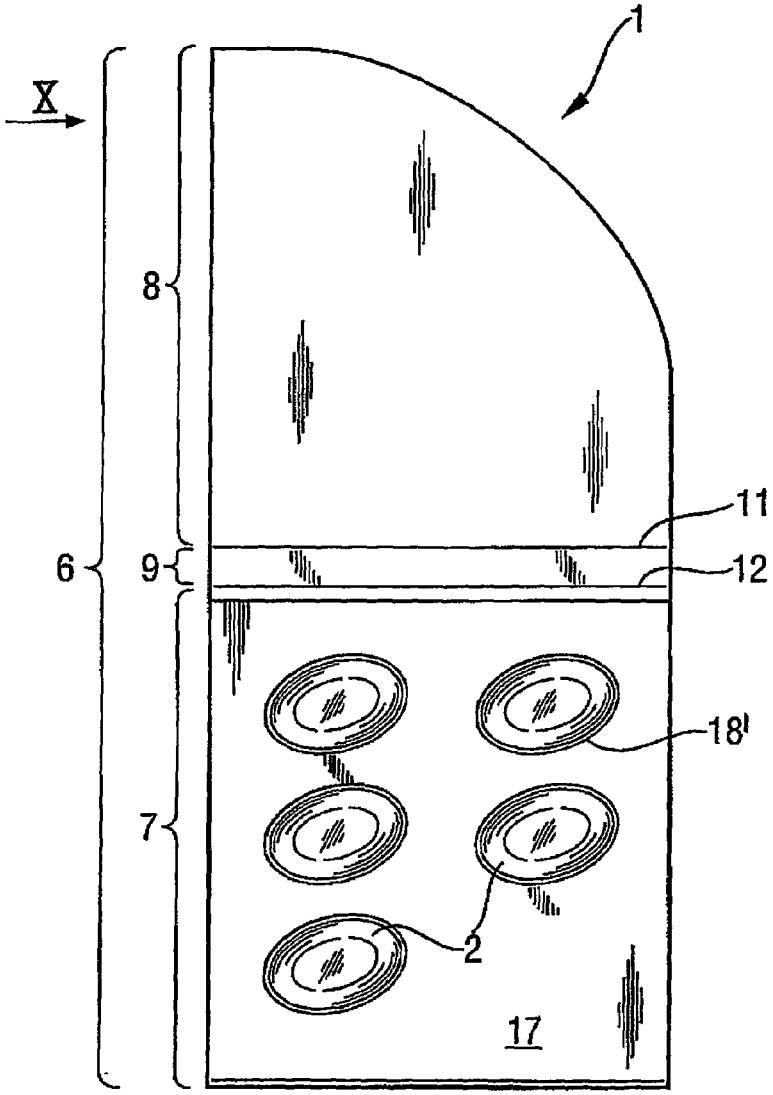

FIG. 9 shows the inside view of a blister unit 1 according to the invention and similar to FIG. 6, in which the blister strip 4, for additional stabilizing on the surface with the blister cavities 2, is connected fixedly to a locking surface 17 of the protective case 6 and is thus surrounded by the protective case 6 in such a way that the blister cavities 2 of the blister strip 4 are accessible and visible from above via punch holes 18' in the locking surface 17.

Figure 10:
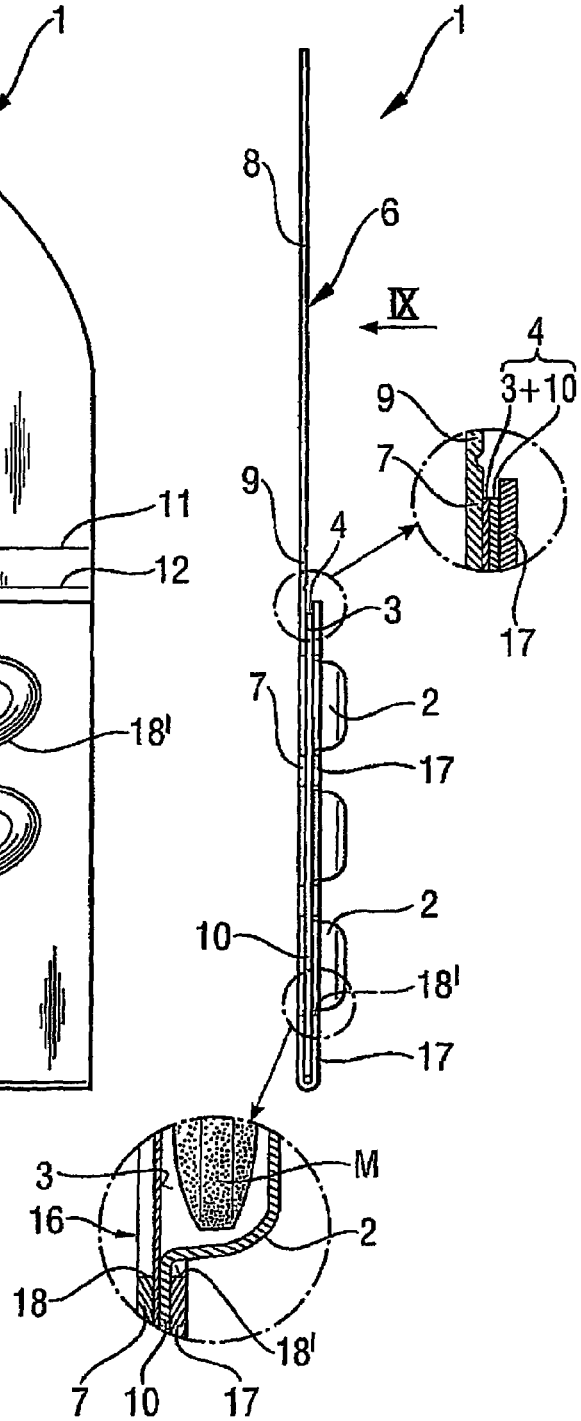

FIG. 10 shows the side view and two enlarged cross-sectional details of a blister unit 1 according to the invention from FIG. 9, seen from the direction X from FIG. 9. It can be seen that the blister strip 4 is fixedly connected largely across the entire surface of the blister base 3 to the rear face 7 of the protective case 6, the blister strip 4 is surrounded by the protective case 6 on three sides, and only the blister cavities 2 are visible through the punch holes 18' in the locking surface 17, as is shown in FIG. 9. As has already been described for FIG. 7 and FIG. 8, this embodiment too has to be equipped with a press-through aid 16 on the rear face 7 of the protective case 6.

Figure 11:
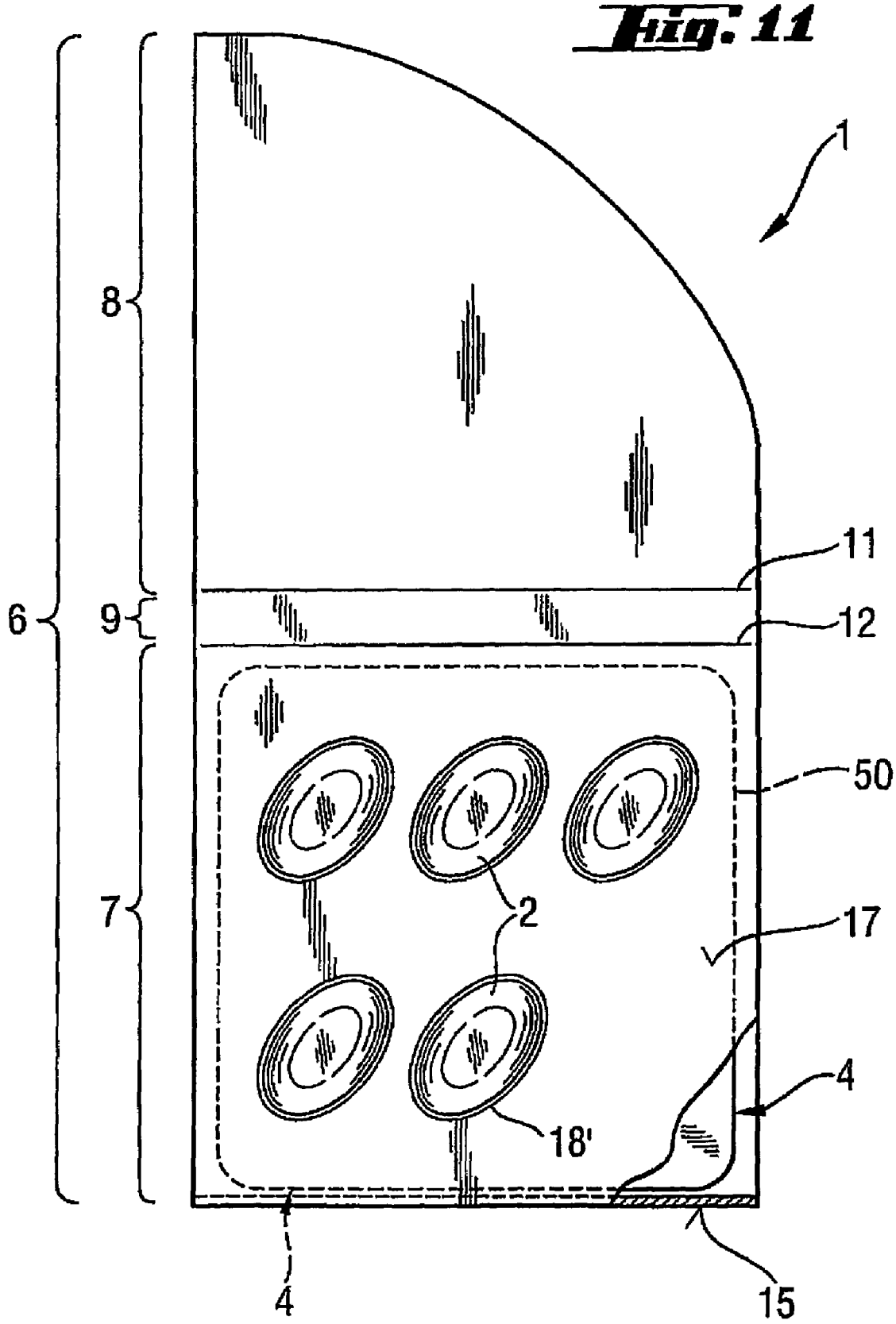

FIG. 11 shows, in comparison to FIG. 2, FIG. 6 and FIG. 9, an alternative arrangement of the blister cavities 2 and punch holes 18' in the protective case 6 when using a blister strip 4 with five blister cavities 2. The perforation line 50 extending around the locking surface 17 indicates the dimension of the blister strip 4 lying underneath.

Figure 12:
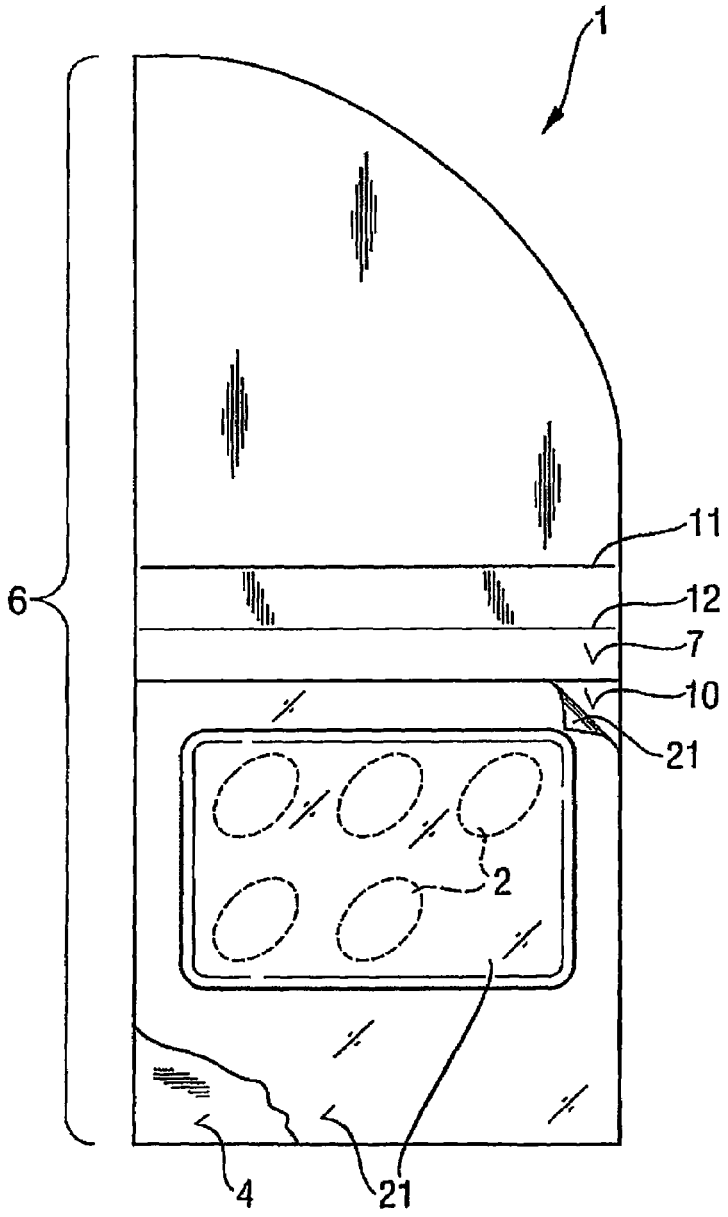

FIG. 12 shows the inside view of a blister unit 1 according to the invention, in which the blister strip 4 is protected not only by the protective case 6 but also by an underseal cap 21. After the underseal cap 21 has been removed by the patient, the appearance of the blister unit 1 corresponds substantially to one of the views in FIG. 2, FIG. 6, FIG. 9 or FIG. 11.

Figure 13:
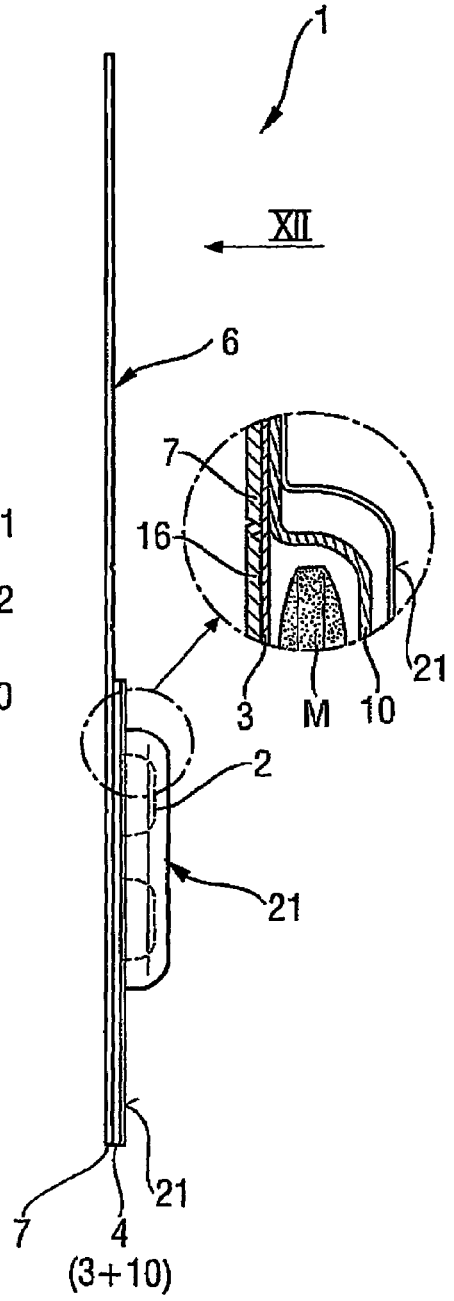

FIG. 13 shows the side view and an enlarged cross-sectional detail of a blister unit 1 according to the invention from FIG. 12. Here, the press-through aid 16 is not represented as a punch hole 18, as in FIG. 7, FIG. 8 or FIG. 10, but instead as one of the further embodiments of press-through aids 16 shown in FIGS. 14 through 18, for example.

FIGS. 14 through 19 show various embodiments of press-through aids 16 through $\mathbf{16}^{V}$ on the rear face 7 of the protective case 6. FIG. 14*a* and FIG. 14*b* show a press-through aid 16 composed of a two-sided punch 27*a* and 27*b* on the rear face 7 with two different widths in each case extending up to half the thickness of the rear face 7, as a result of which a predetermined breaking web 51 remains. FIG. 15 shows a press-through aid $\mathbf{16}^{I}$ composed of four ellipse segment punches 19 with a straight transverse slit 19*a*. FIG. 16 shows a press-through aid $\mathbf{16}^{II}$ composed of four ellipse segment punches 19 and two straight transverse slits 19*a* which intersect at right angles. FIG. 17 shows a press-through aid $\mathbf{16}^{III}$ composed of four ellipse segment punches 19 and four straight transverse slits 19*a* in the portions between the ellipse segment punches 19. FIG. 18 shows a press-through aid $\mathbf{16}^{IV}$ composed of an elliptical perforation 20 and four straight transverse slits 19*a*. FIG. 19 shows a press-through aid $\mathbf{16}^{V}$ in the form of a punch hole 18 according to FIG. 8.

Figure 20:
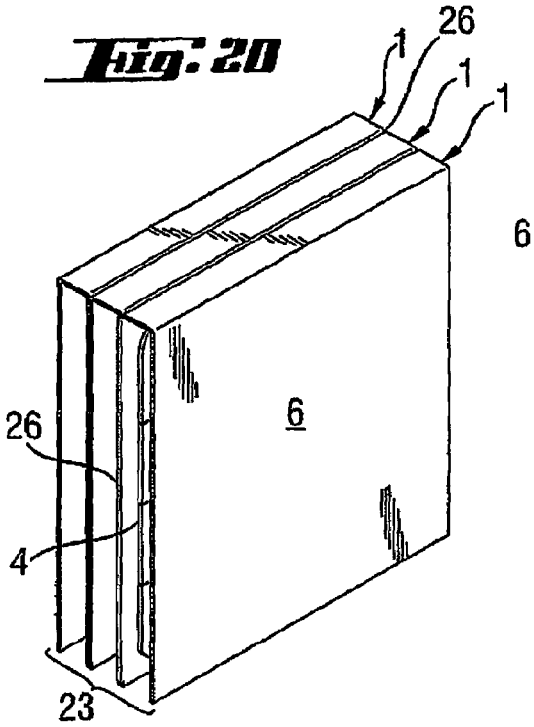
FIGS. 20 through 24 show various views of groups of blister units.
Figure 21:
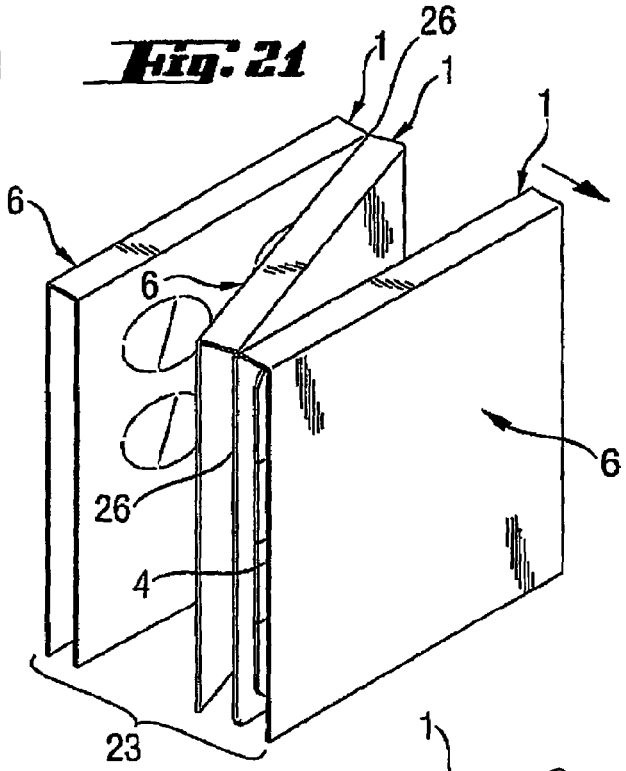
Figure 22:
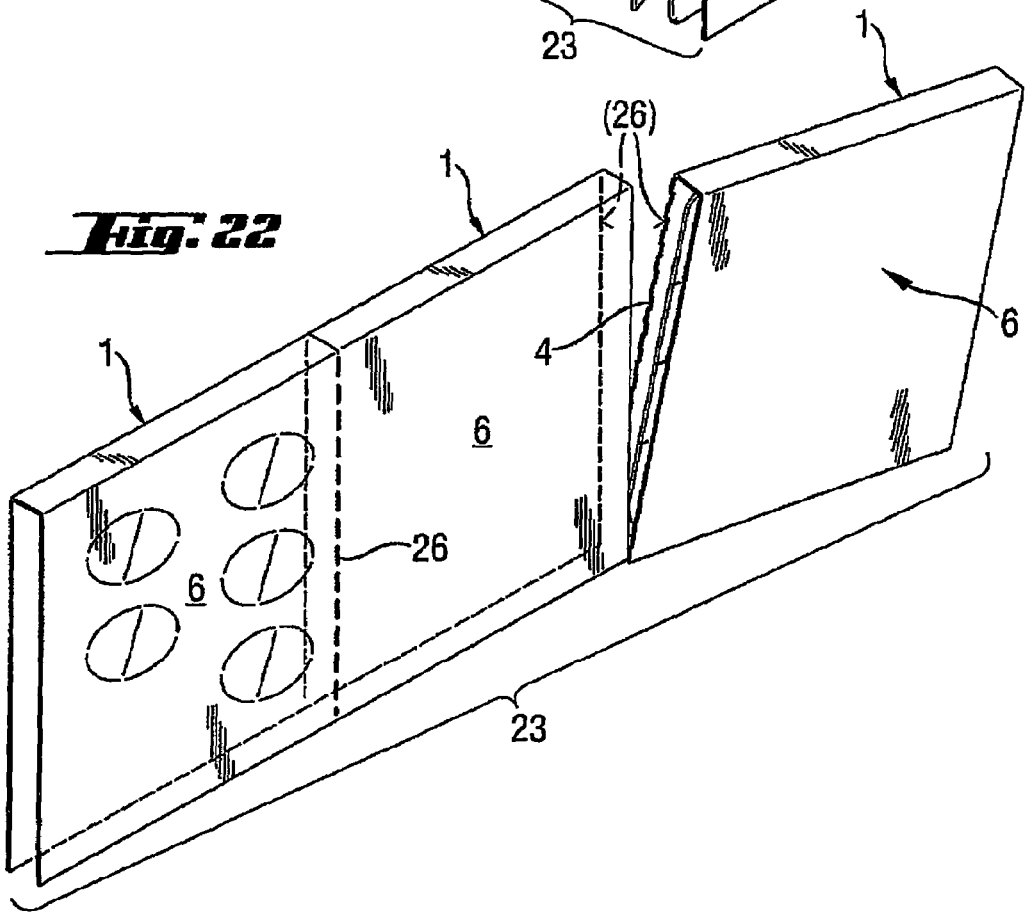
Figure 23:
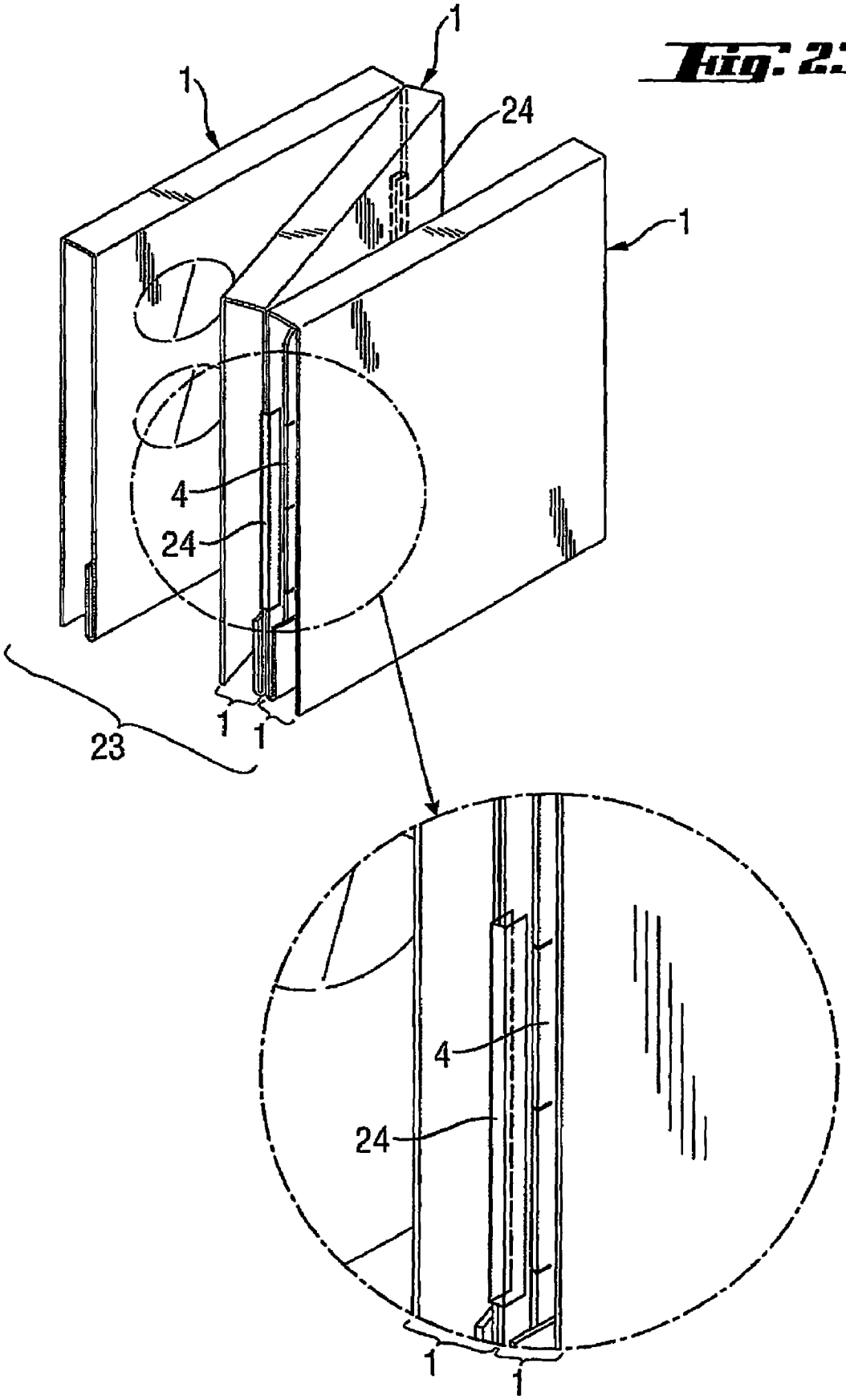

FIGS. 20 through 23 show a group 23 of three blister units 1 in different phases of the folding-out and detachment procedure. FIG. 20 shows a group 23 of three blister units 1 in the folded-together state, in which the individual blister units 1 are coplanar with respect to one another and thus the two-dimensional extent of the folded group 23 of blister units 1 substantially corresponds to the two-dimensional extent of an individual blister unit 1. FIG. 21 shows a partially folded-out group 23 of three blister units 1, where the connection 25 between the individual blister units 1 is composed of a common fold edge 26 of the protective cases 6 of two interconnected blister units 1. FIG. 22 shows how a blister unit 1 can be removed from a group 23 of three blister units 1 by tearing at a fold edge 26, this being promoted by a perforation along this fold edge 26. After an individual blister unit 1 has been torn from a group 23 of three blister units 1, the group 23 of the remaining two interconnected blister units 1 can be folded together again into a compact form, similar to what is shown in FIG. 20, but now with just two instead of three blister units 1. FIG. 23 shows a group 23 of three blister units 1, the individual blister units 1 being interconnected by adhesive tape 24.

Figure 24:
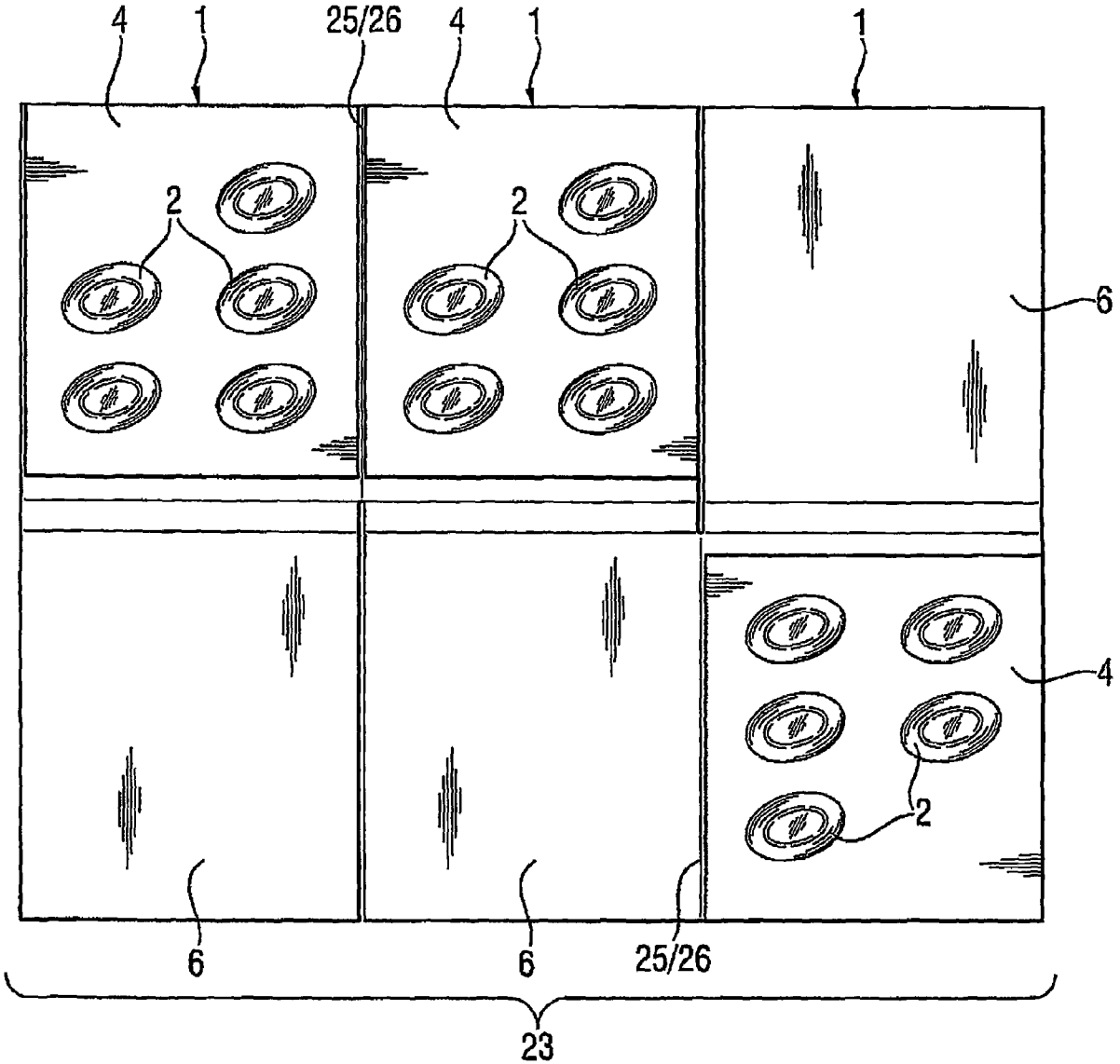

FIG. 24 shows the top view of a group 23 of three blister units 1 in the completely folded-out, planar arrangement. Two blister units 1, which thus come to lie next to one another, have a common fold edge 26 of their protective cases 6 which acts as connection 25 between the interconnected protective cases 6, and a perforation may optionally be present to facilitate the separation of a blister unit 1 along this fold edge 26.

Figure 25:
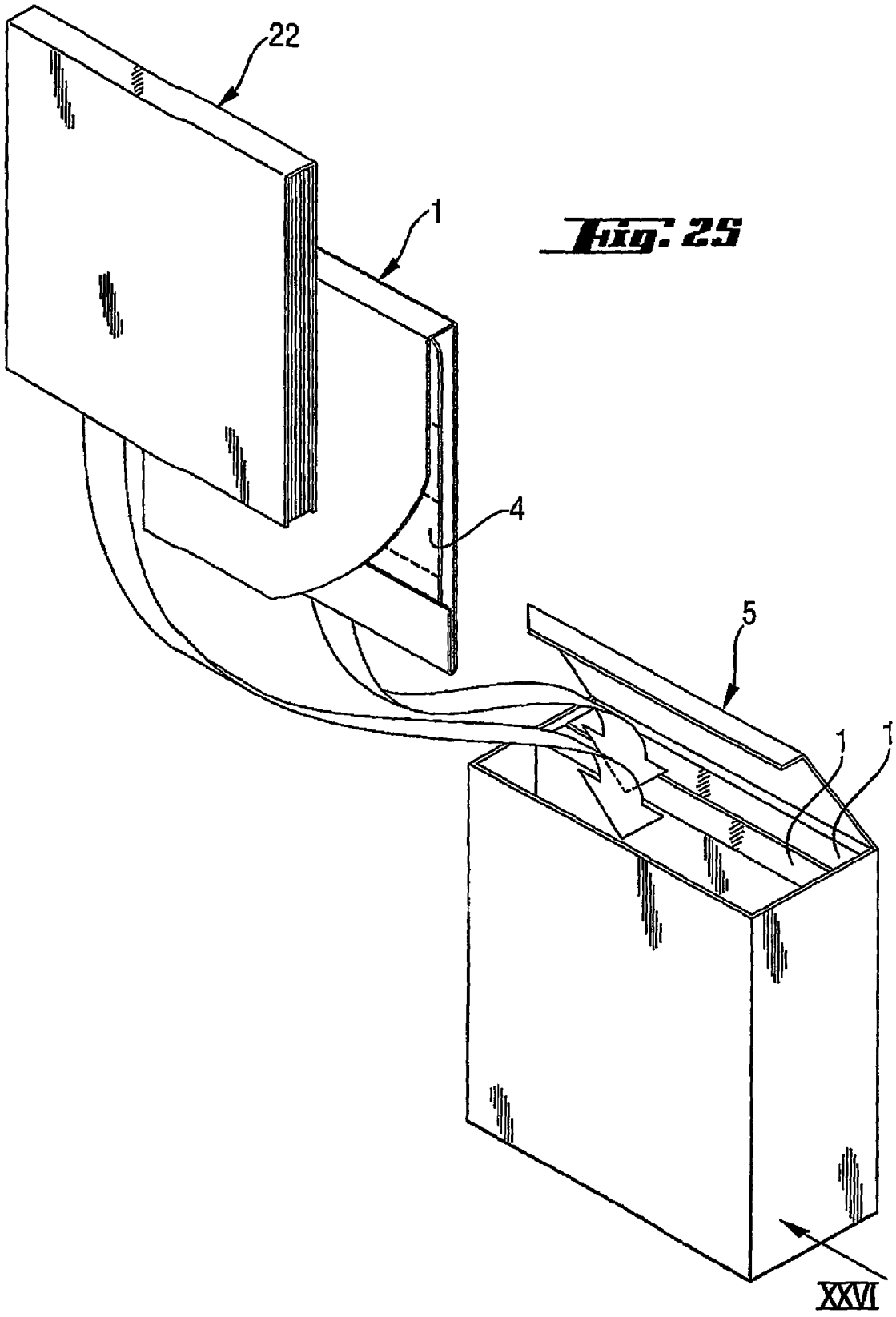

FIG. 25 shows an embodiment of an outer package 5, namely a folding box. The folding box can be closed with a hinged lid and it has substantially the same dimensions as the blister units 1, to be contained in it, and as the leaflet 22 with the patient information and directions for use.

Figure 26:
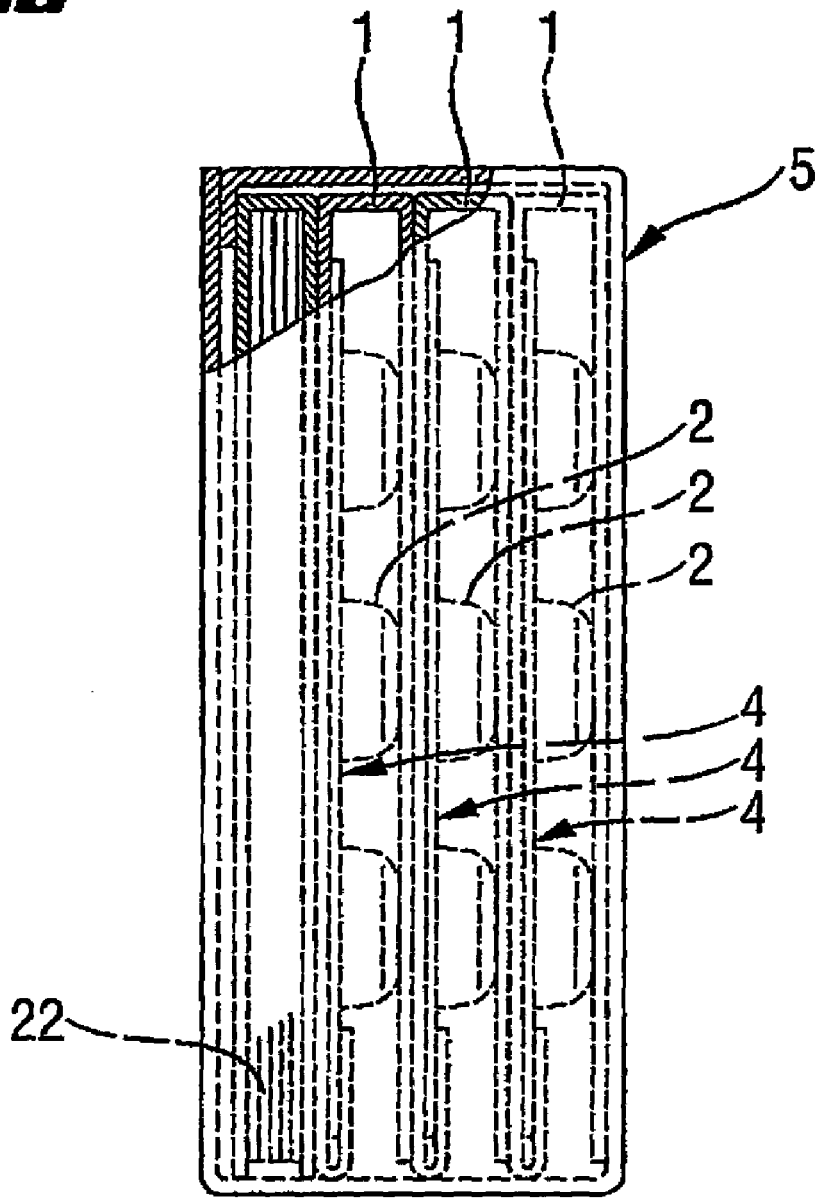

FIG. 26 shows in a side view, seen from the direction XXVI in FIG. 25, the arrangement of the leaflet 22 and of the blister units 1 in a possible outer package 5. The blister units 1 are here arranged in such a way that the blister cavities 2 of the individual blister units 1 come to lie one above the other.

Figure 27:
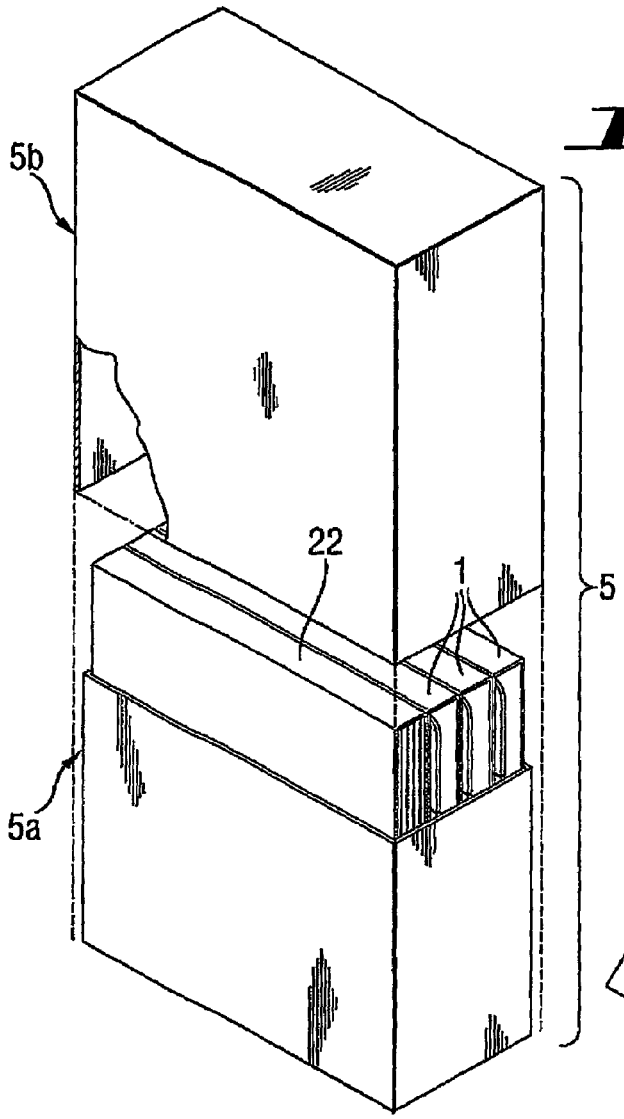

FIG. 27 shows an embodiment of an outer package 5, namely a sliding box, made up of a base box 5*a* and of a lid 5*b*, the lid 5*b* being used to protect during transport and storage; in this particular embodiment, the height of the lid corresponds substantially to the height of the pack content; a shortened base box 5*a* in comparison to the lid 5*b* permits simple removal of the pack content or of parts of the pack content from the base box 5*a*, since the latter is lower than the pack content, and the part of the pack content to be removed is thus easy to take hold of.

Figure 28:
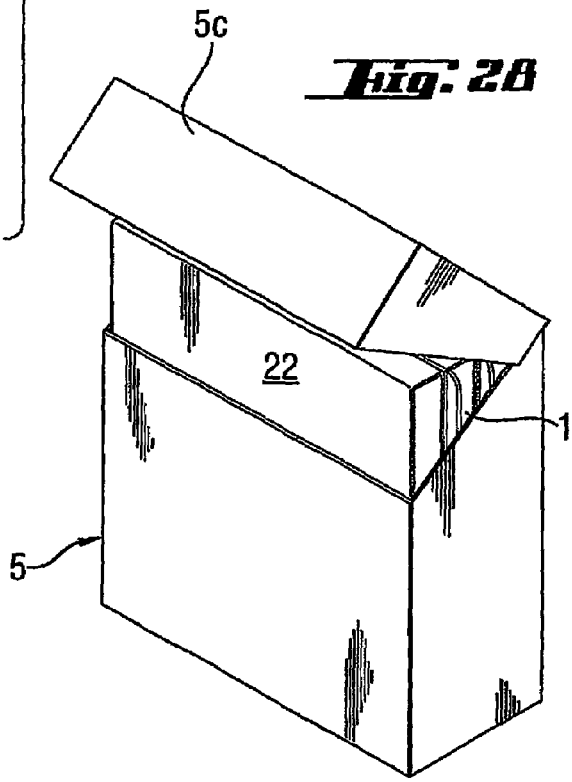

FIG. 28 shows an embodiment of an outer package 5, namely of the cigarette packet type, where the outer package 5 is provided with a hinged lid 5*c* for opening and closing.

FIG. 29 shows an embodiment of an outer package 5, namely a base box 5*a* and transparent cellophane wrapper 29, where the base box 5*a*, as has already been described for FIG. 27, is lower than the pack content and, consequently, part of the pack content is already visible before the outer package is removed or opened.

FIG. 30 shows an embodiment of an outer package 5, namely a base box 5*a* and lid 5*b* and a transparent cellophane wrapper 29, where the pack content overall is higher than the base box 5*a* and the lid 5*b* together, and so part of the pack content is already visible before the outer package is removed or opened.

FIG. 31 shows an embodiment of an outer package 5, namely a box with grip recess 5*d* and transparent cellophane wrapper 29.

Figure 32:
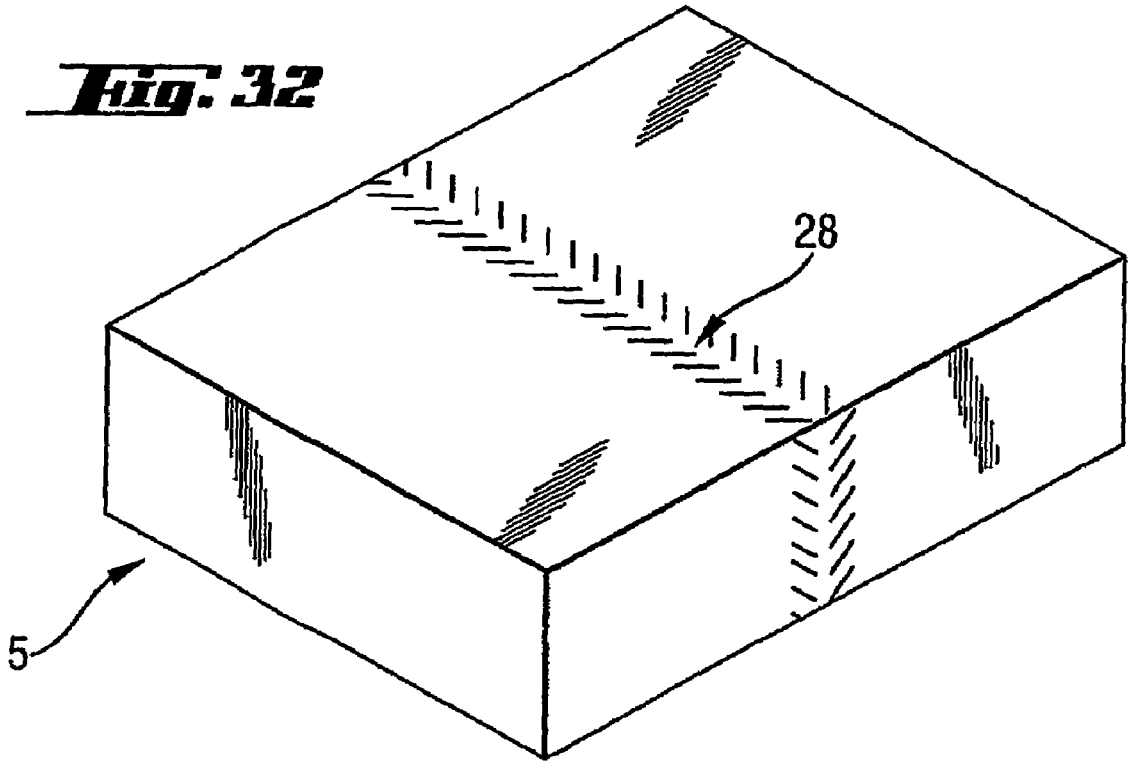
Figure 33:
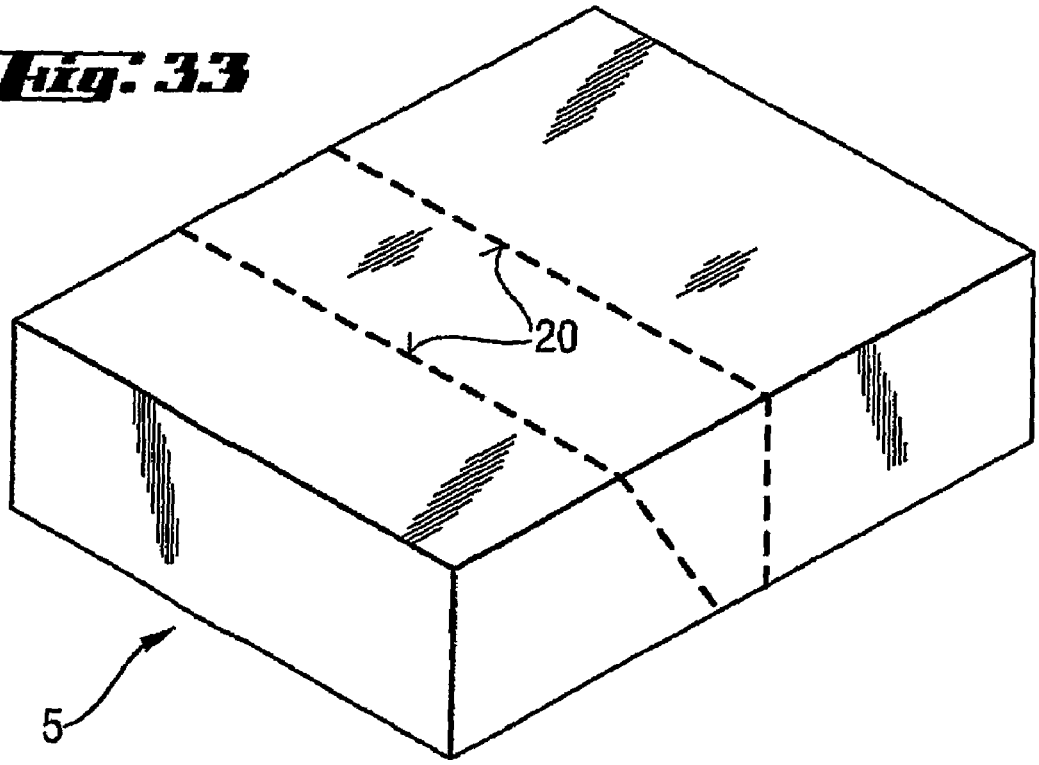

FIGS. 32 and 33 show embodiments of outer packages 5, namely two closed snap-open or tear-open boxes with tear tab 28 (FIG. 32) or perforation 20 (FIG. 33).

Figure 34:
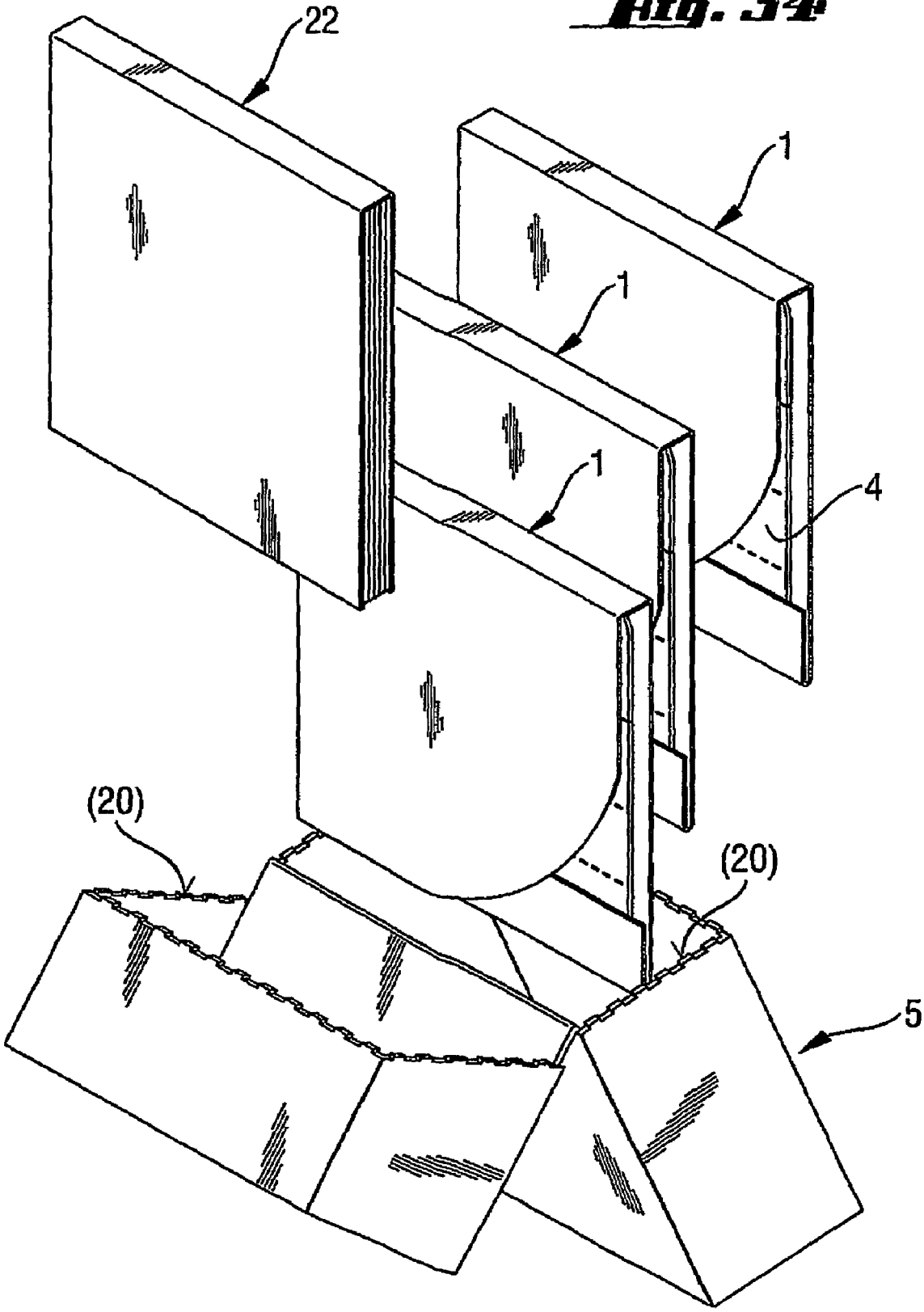

FIG. 34 shows an outer package 5 as snap-open or tear-open box according to FIG. 33 after it has been opened. It can be set down on a surface when snapped open, and the pack content or part of the pack content can be removed.

Figure 35:
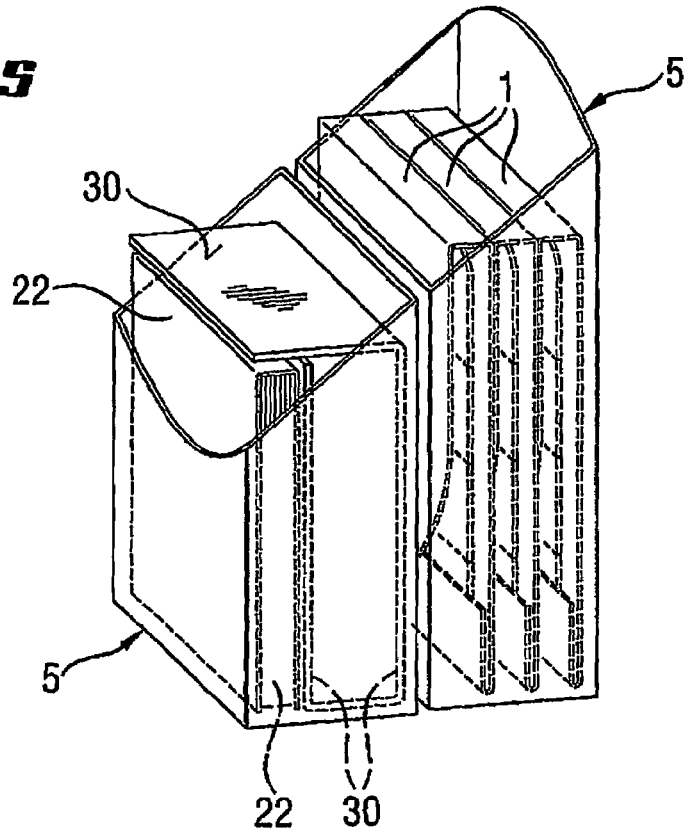

FIG. 35 shows an embodiment of an outer package 5 in the form of a snap-open box which can be set down on a surface. To secure the pack content, the snap-open box can additionally contain filling material 30, if desired. After it has been snapped open, the two individual parts of the outer package can be used singly or in combination.

Figure 36:
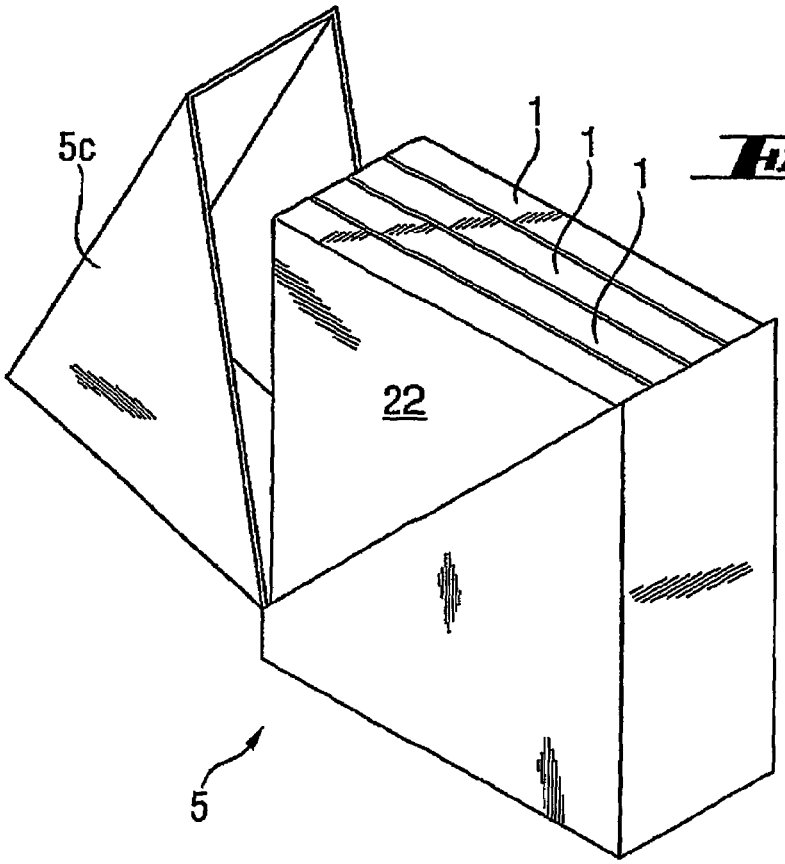

FIG. 36 shows an embodiment of an outer package 5, namely a diagonal flap box, in which the hinged lid 5*c* is folded open diagonally to the side and the pack content is thus made accessible.

Figure 37:
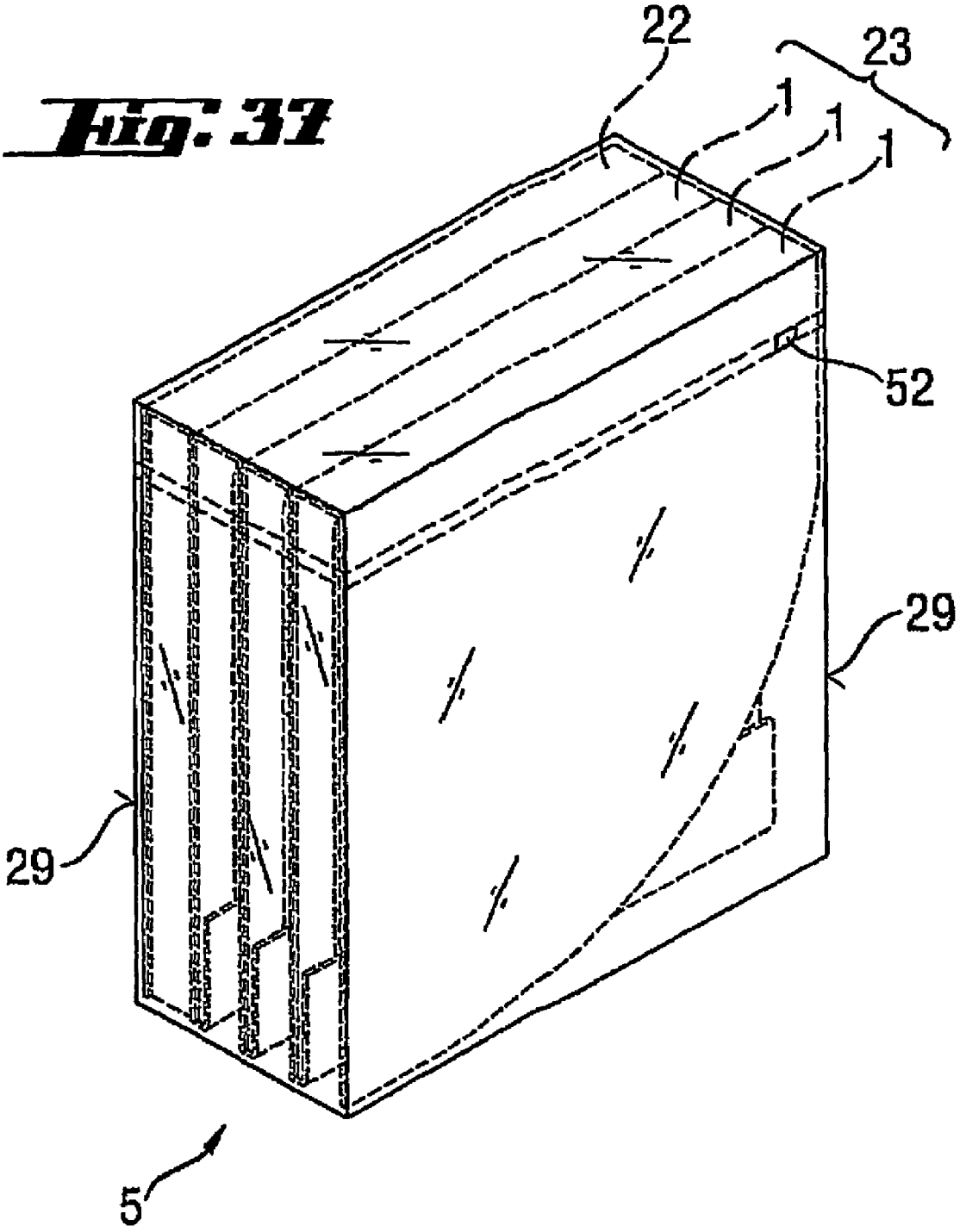

FIG. 37 shows an embodiment of an outer package 5, namely a simple cellophane wrapper 29 around the pack content, for example around a group 23 of three blister units 1 and a leaflet 22. The cellophane wrapper 29 can here be opened, for example, via a tear strip 52, or in another similar way. In a preferred embodiment, the tear strip 52 can be configured in such a way that it differs in color from the cellophane wrapper 29 and can thus be more easily found.

Figure 38:
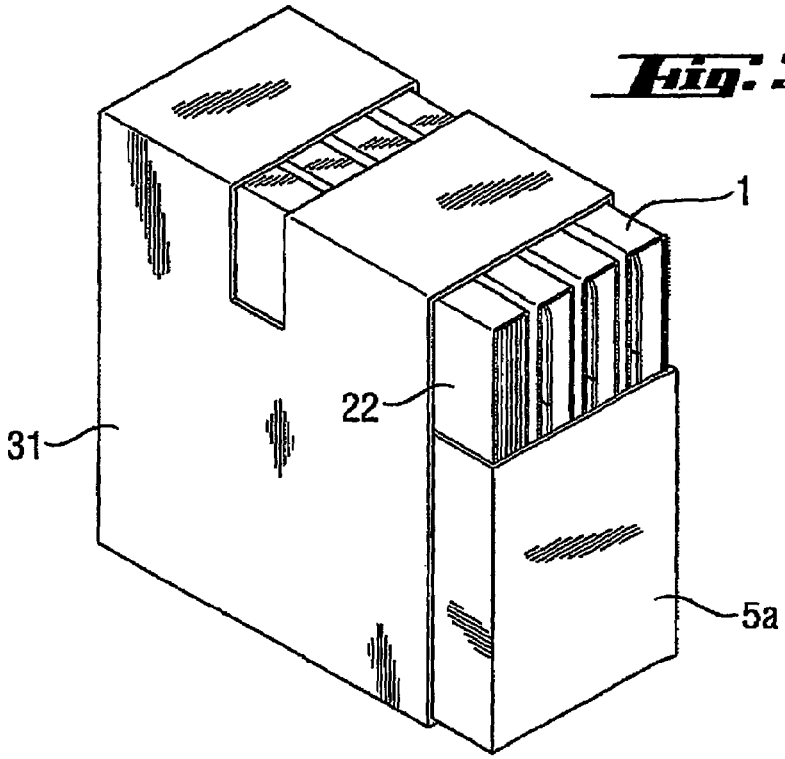
Figure 39:
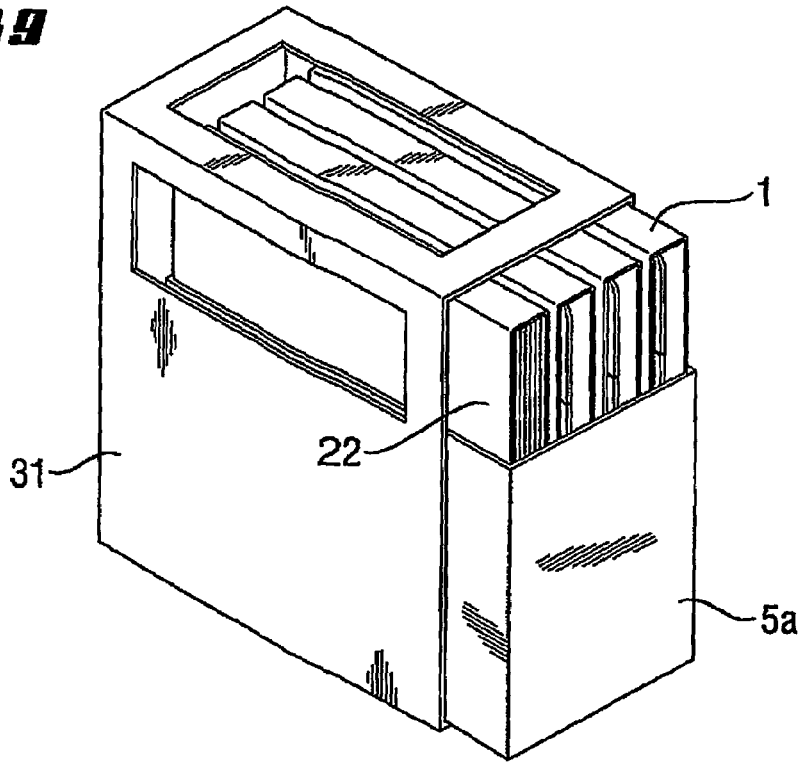
Figure 40:
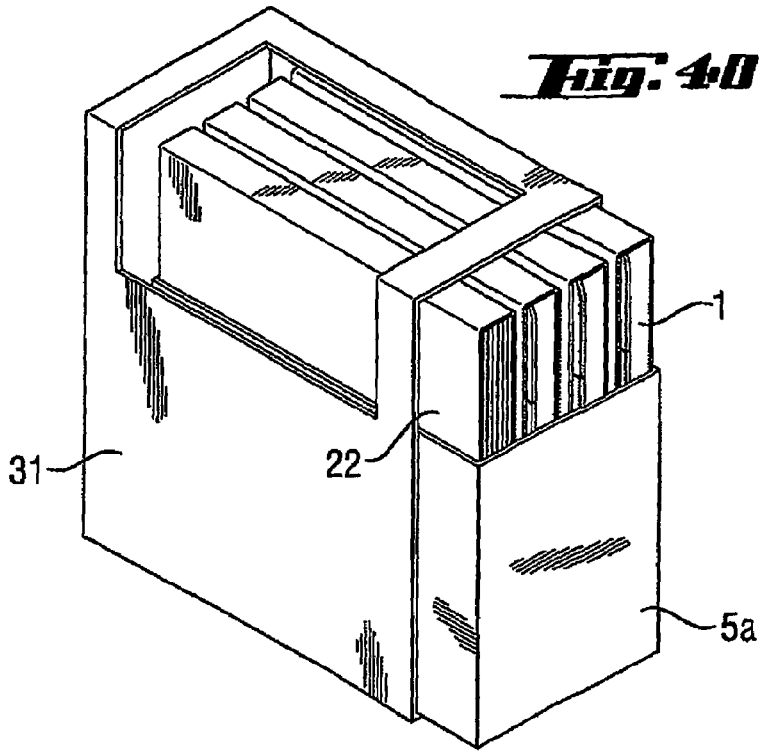
Figure 41:
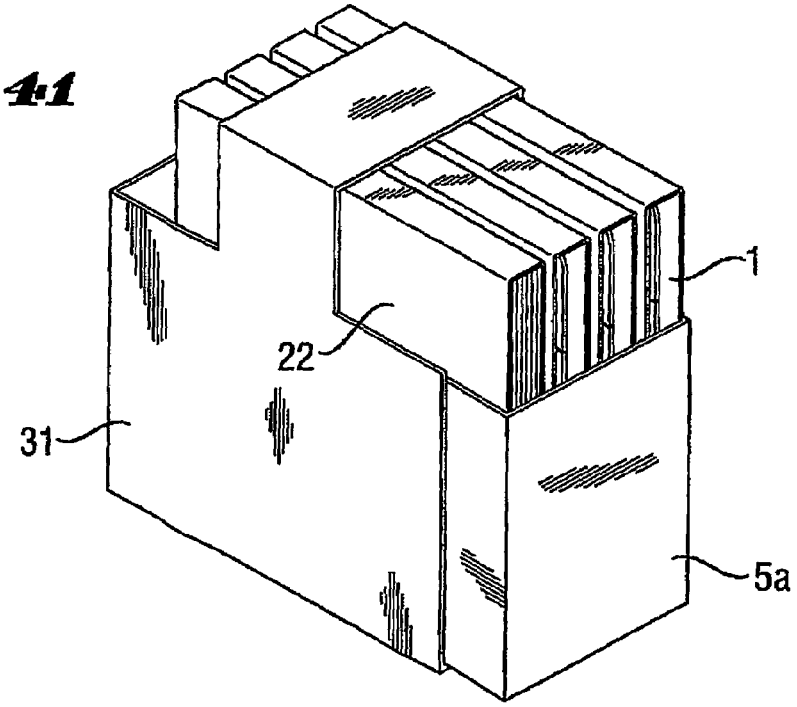

FIG. 38 shows an embodiment of an outer package 5, namely a base box 6*a* and a clamp sleeve 31 which encloses the base box 5*a* and the pack content 1, 22, and this clamp sleeve 31 provides protection during transport and storage. To remove the pack content 1, 22, the base box 5*a* is pushed out of the clamp sleeve by pushing or pulling. The shortened base box 5*a* compared to the pack content 1, 22 permits simple removal of the pack content or of parts of the pack content. FIGS. 38 through 41 show various embodiments of such a clamp sleeve 31.

Figure 42:
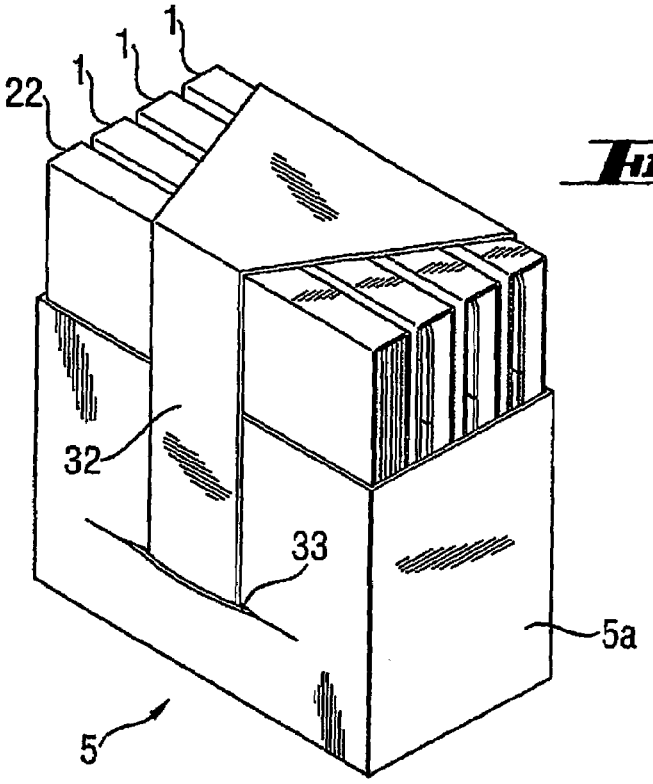
Figure 43:
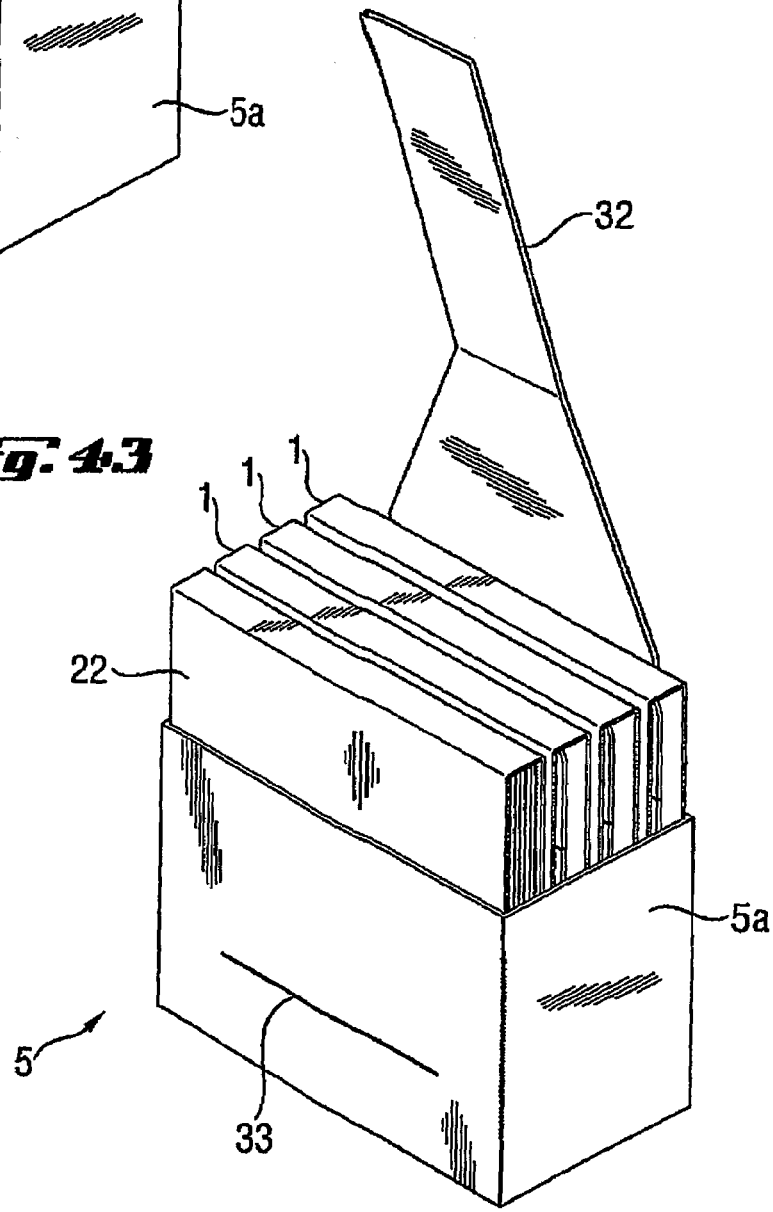
Figure 44:
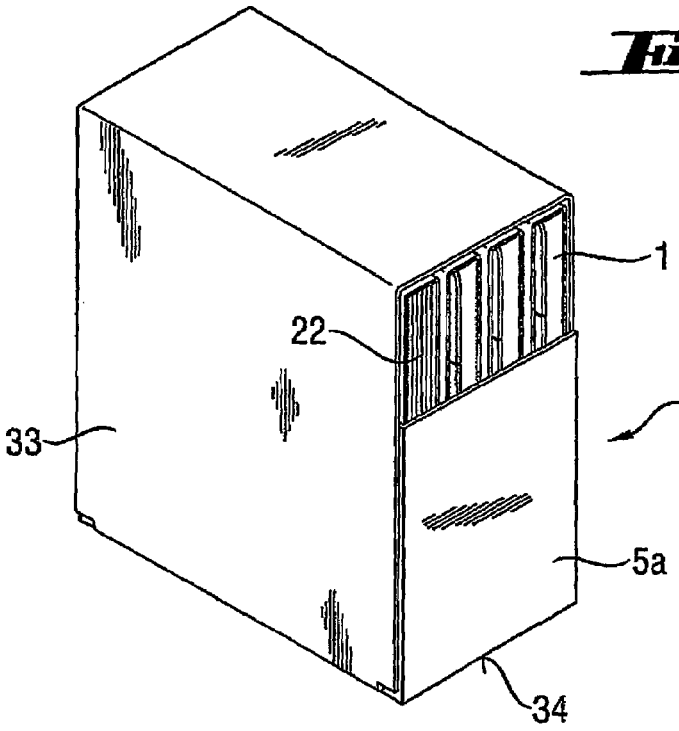
Figure 45:
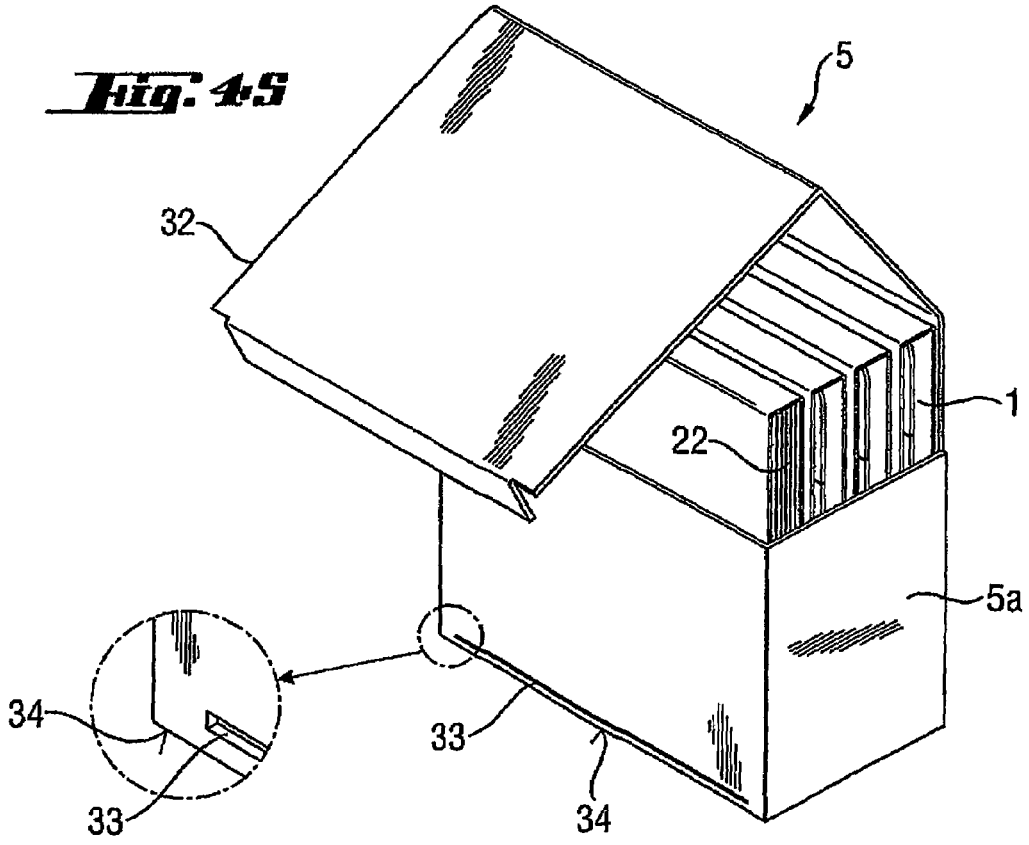

FIGS. 42 through 45 show embodiments of two outer packages 5 composed of a base box 5*a*, each provided with a sealing strap 32. FIG. 42 and FIG. 43 show a narrow sealing strap 32 which, in order to close the outer package 5, is inserted into a slit 33 at about one third of the height of the base box 5*a*. FIG. 44 and FIG. 45 show a sealing strap 32 which, in order to close the outer package 5, is inserted into a slit 33 near the bottom 34 of the base box.

Figure 46:
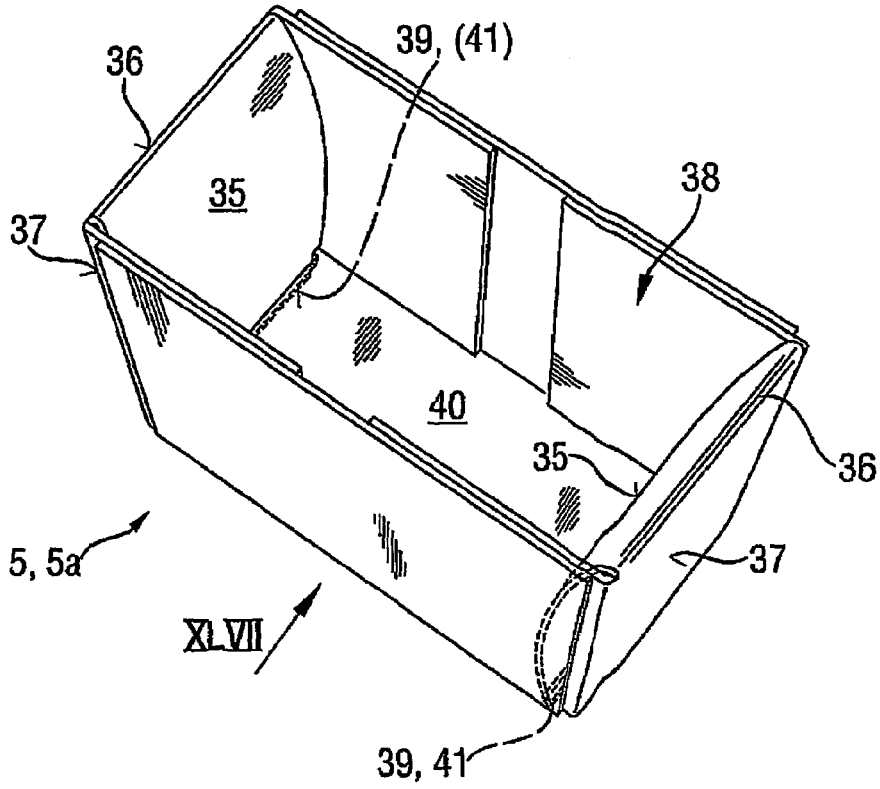

FIG. 46 shows, in a polymetric birdseye view, an embodiment of an outer package 5 without pack content, namely an empty base box 5*a* which, at opposite side walls 37, is provided with resilient tabs 35 in the inside of the base box 5*a*.

Figure 47:
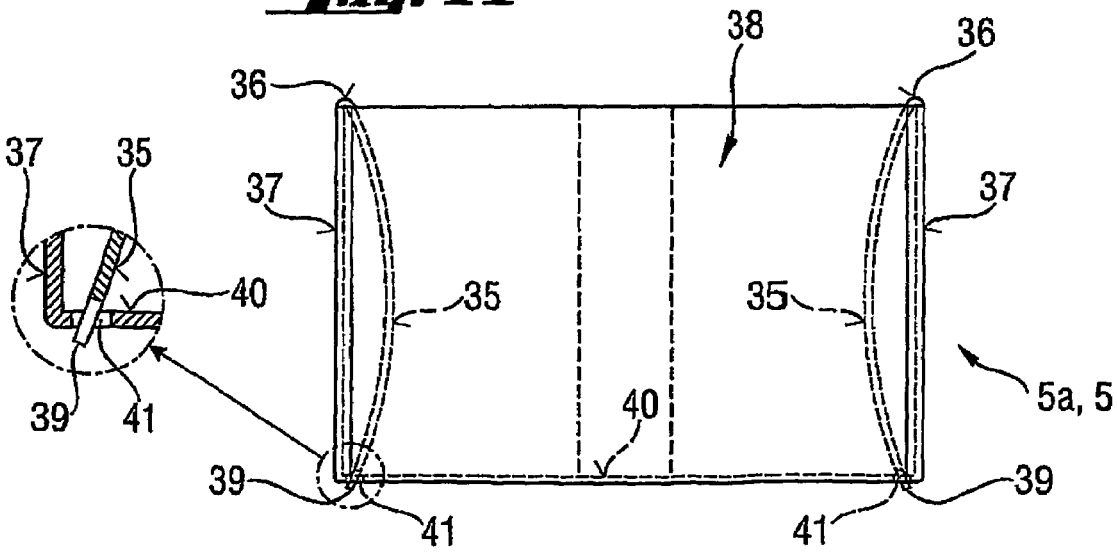
Figure 4B:
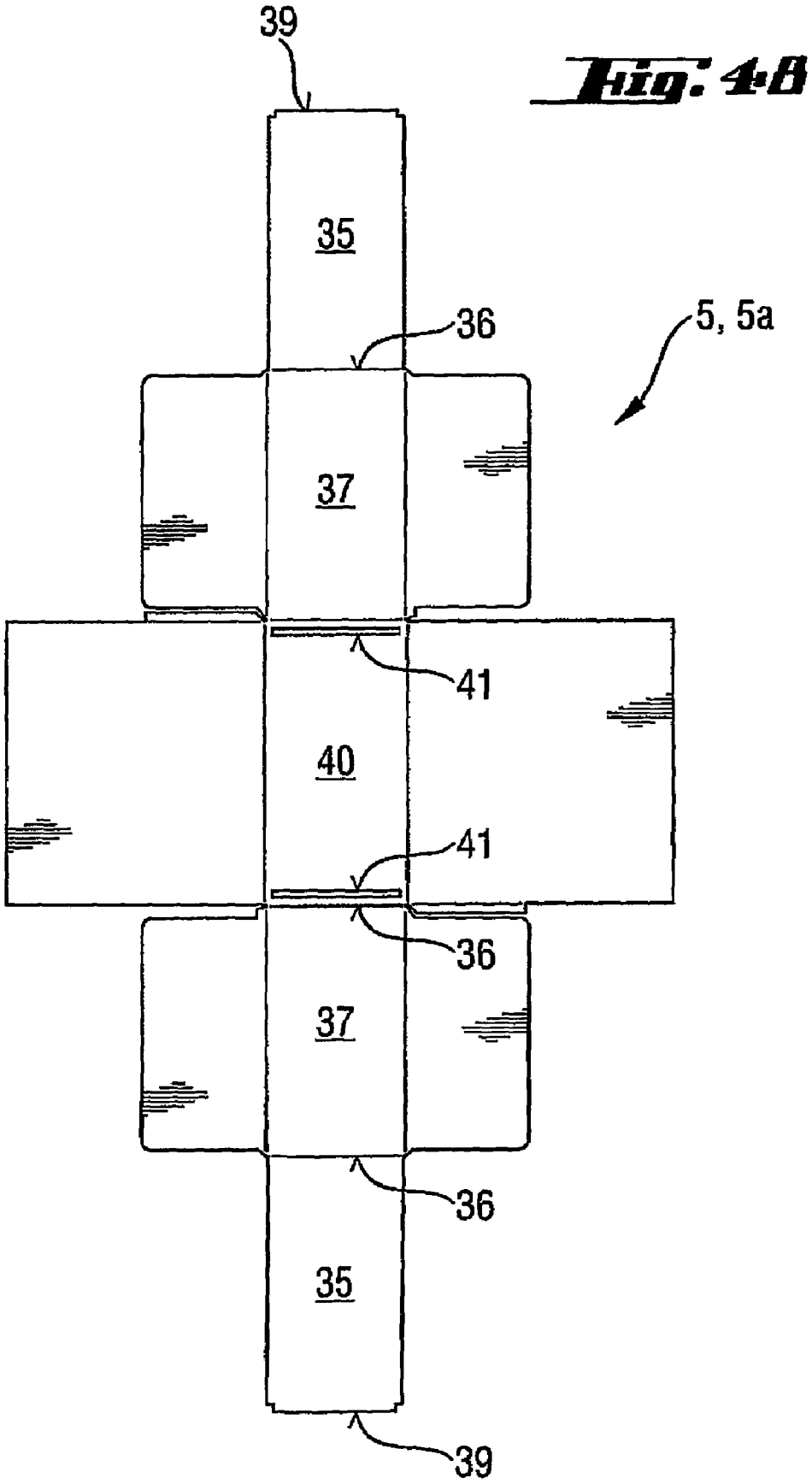

FIG. 47 shows the outer package 5 in a side view, seen from the direction XLVII from FIG. 46, namely a base box 5*a* with resilient tabs 35, where the resilient tabs 35 are connected to the base box 5*a* via in each case a common bend/fold edge 36 with the side wall 37 at the opening 38 of the base box 5*a* and via the resilient tab end 39 at the bottom 40 of the base box 5*a*. The enlarged cross-sectional detail in FIG. 47 shows that the resilient tab 35 is fixed by inserting the resilient tab end 39 into a slit 41 in the bottom 40 of the base box 5*a*.

FIG. 48 shows the top view of an outer package 5 in the form of a punched blank for a base box 5*a* with resilient tabs 35 as in FIG. 46 and FIG. 47 in the fully opened, planar arrangement. The resilient tabs 35 are connected integrally to a side wall 37 of the punched blank via a common bend/fold edge 36, whereas the resilient tab end 39 remote from this common bend/fold edge 36 is inserted into the slit 41 provided for this purpose at the bottom 40 of the base box 5*a* and of the punched blank only during or after folding and optionally adhesive bonding to form a box.

Figure 49:
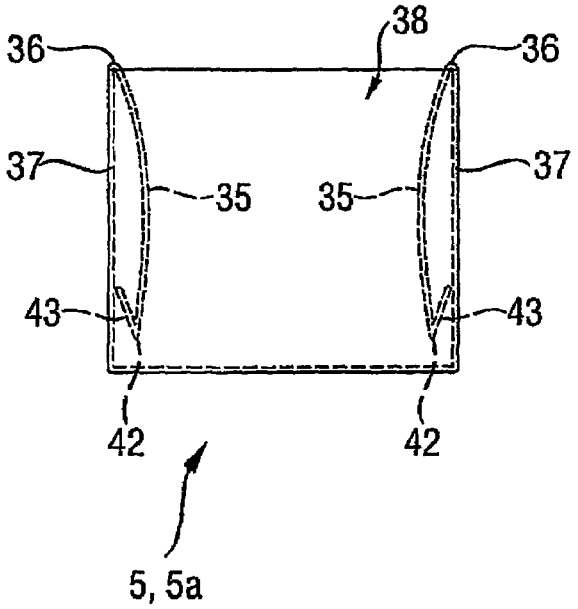

FIG. 49 shows the side view of an outer package 5 similar to the view in FIG. 47, namely a base box 5*a* with resilient tabs 35, where the resilient tabs 35 are fixedly connected to the base box 5*a* only via in each case a common bend/fold edge 36 with the side wall 37 at the opening 38 of the base box 5*a*. The resilient tabs 35 are connected in each case via a fold line 42 to a resilient tab extension 43 which braces the resilient tabs 35 against the respective side wall 37; the resilient tab extension 43 can touch the side walls 47, but does not have to be permanently connected to these. In this embodiment of resilient tabs 35, the slits 41, as are shown in FIGS. 46 through 48, can be omitted.

Figure 50:
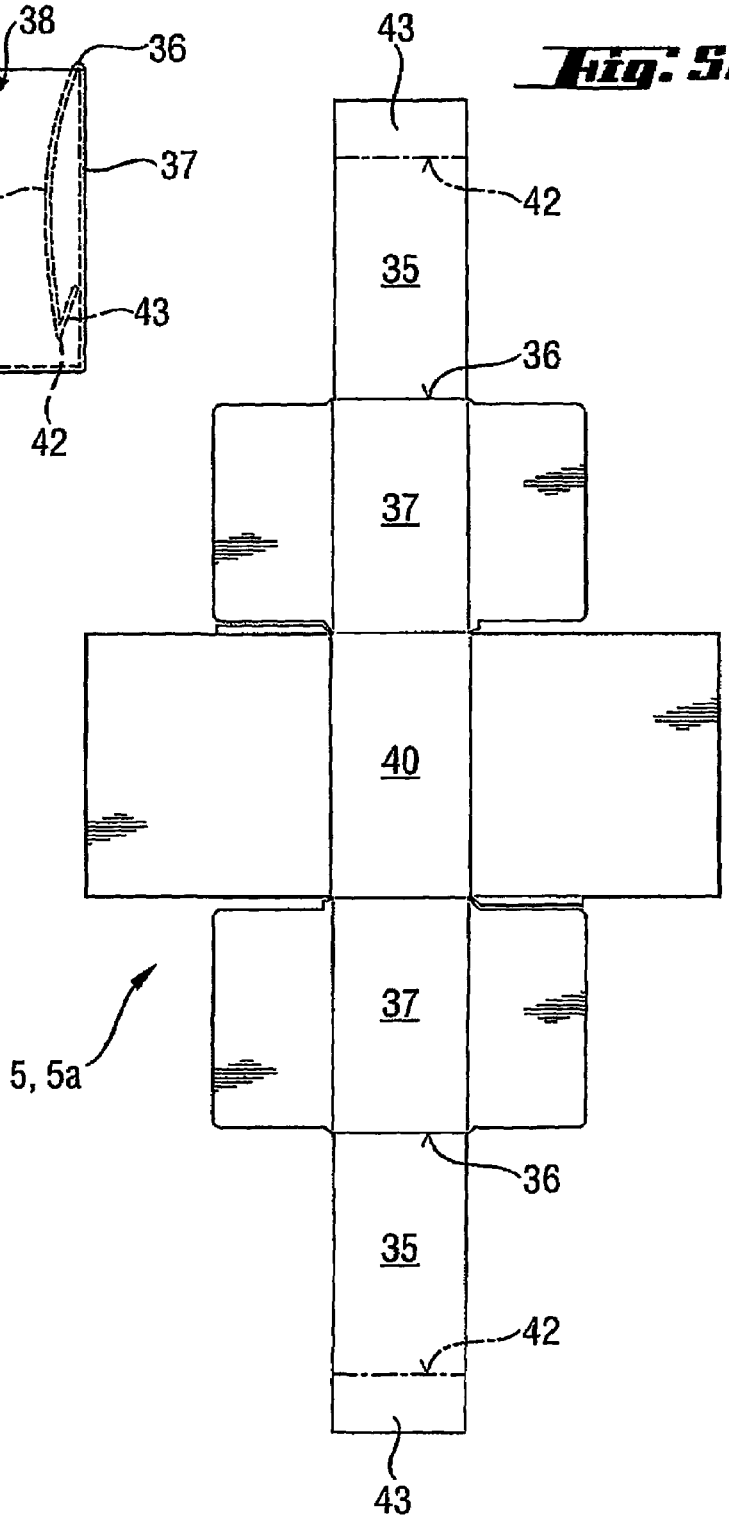

FIG. 50 shows the top view of a punched blank for an outer package 5 in the form of a base box 5*a* with two resilient tabs 35 as in FIG. 49 in the fully opened, planar arrangement. The resilient tabs 35 are connected integrally to a side wall 37 of the punched blank for the base box via a common bend/fold edge 36. The resilient tabs 35 are each connected via a fold line 42 to a resilient tab extension 43. When folding the blank into a base box 5*a*, the resilient tab extension 43 at the fold line 42 and the resilient tab 35 at the common bend/fold edge 36 with the side wall 37 are buckled inward so that the resilient tab extension 35 in the finished base box 5*a* comes to lie in the hollow space obtained between the resilient tab 35 and the side wall 37 (see FIG. 49).

Figure 51:
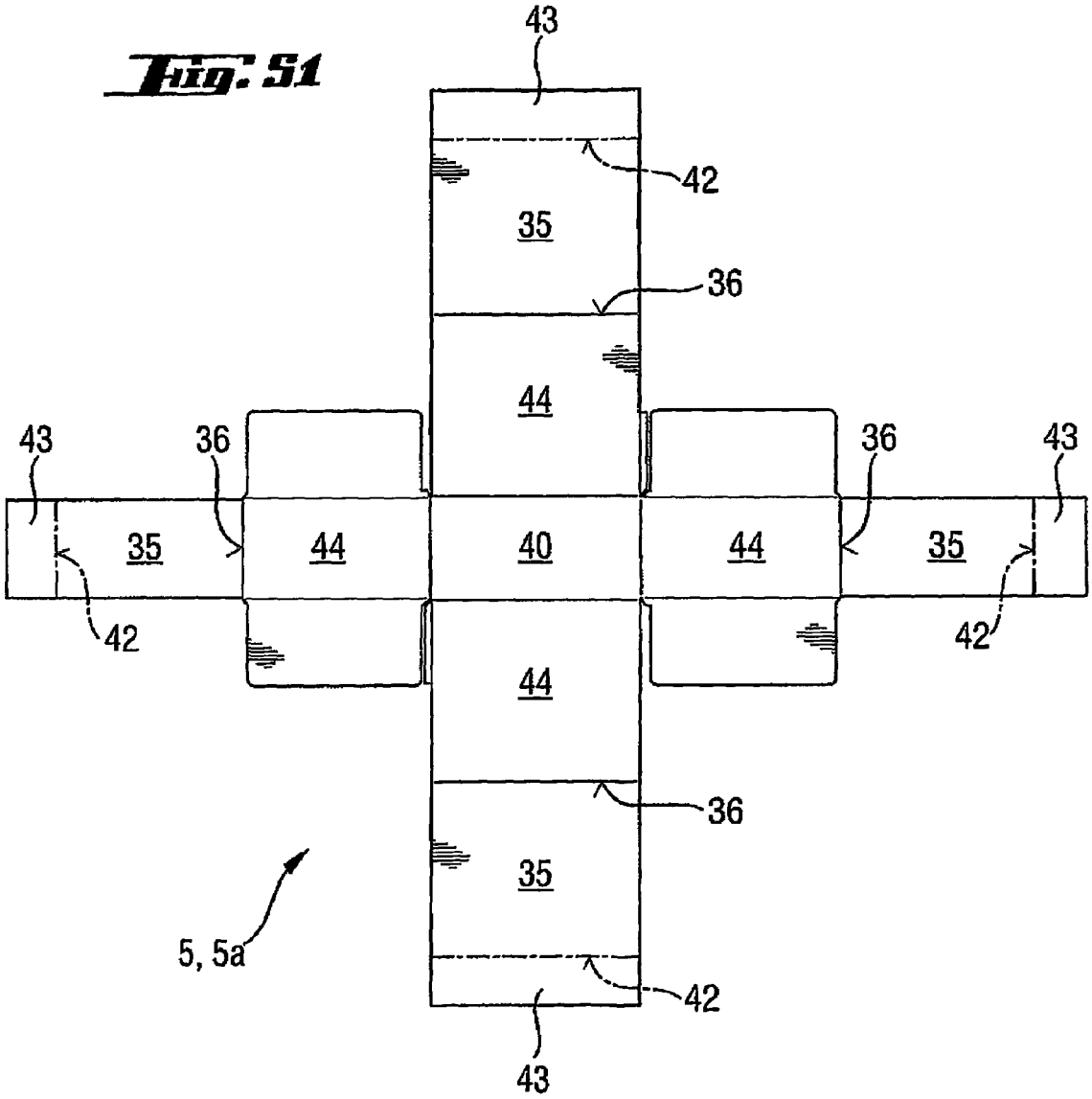

FIG. 51 shows the top view of a punched blank for an outer package 5 in the form of a base box 5*a* with four resilient tabs 35, as in FIG. 49 and FIG. 50, in the fully opened, planar arrangement. In this embodiment, such resilient tabs 35 with resilient tab extensions 43 are present on all four walls 44 in the inside of the folded base box 5*a*. The other reference labels are as have been indicated above and have the same meanings.

Figure 52:
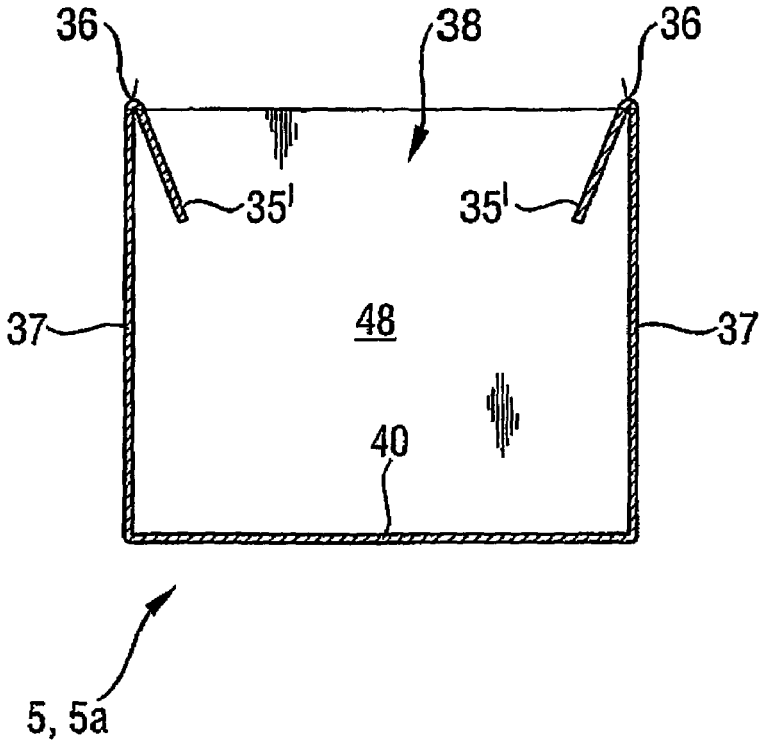

FIG. 52 shows a longitudinal section of an outer package 5, namely a base box 5*a* with short resilient tabs 35', where the short resilient tabs 35' are connected to the outer package 5 in each case only via a common bend/fold edge 36 with the side wall 37 at the opening 38 of the base box 5*a*. The short resilient tabs 35' thus protrude freely into the interior 48 of the empty base box 5*a*.

Figure 53:
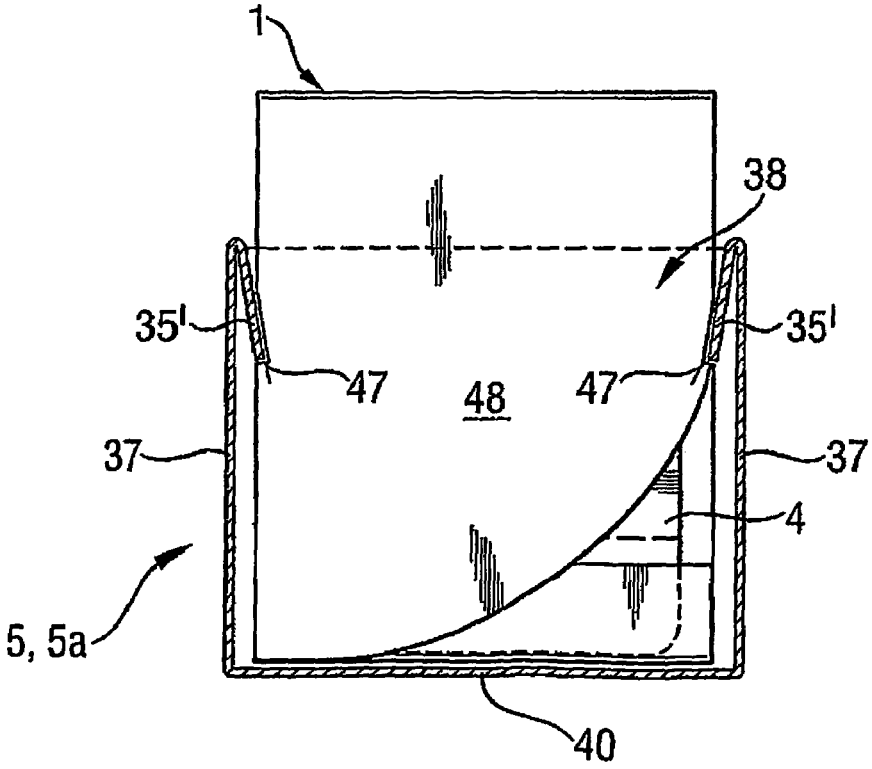

FIG. 53 shows, like FIG. 52, the longitudinal section through the outer package 5, but with a blister unit 1 contained in it. In this particular illustrative embodiment of the present invention, the blister unit 1 is provided on the sides with notches 47 into which the short resilient tabs 35' catch resiliently and the blister unit 1 is thus locked in the outer package 5 or base box 5*a*. It will be expressly noted that the locking action of the short resilient tabs 35' is not linked to the presence of notches 47 in the blister units 1. This means that, with the correct choice of embodiment of the short resilient tabs 35', particularly in respect of dimension, material and fiber direction, the desired locking action can also be achieved without notches 47 in the blister units 1.

Figure 54:
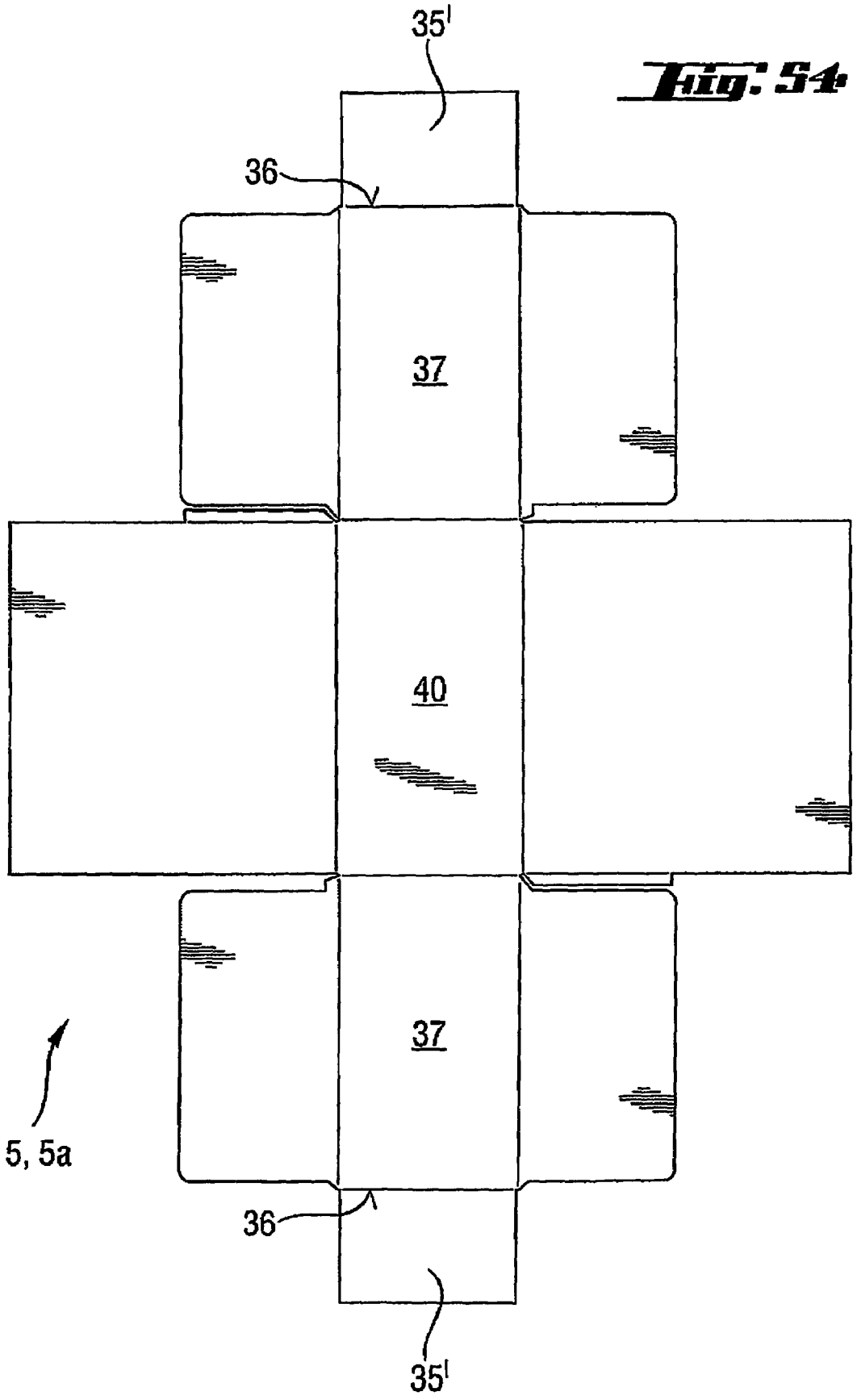

FIG. 54 shows the top view of the punched blank for an outer package 5 in the form of a base box 5*a*, similar to FIG. 48, but with two short resilient tabs 35', as shown in FIG. 52, in the fully opened, planar arrangement. In this particular embodiment, such short resilient tabs 35' are present on both side walls 37.

Figure 55:
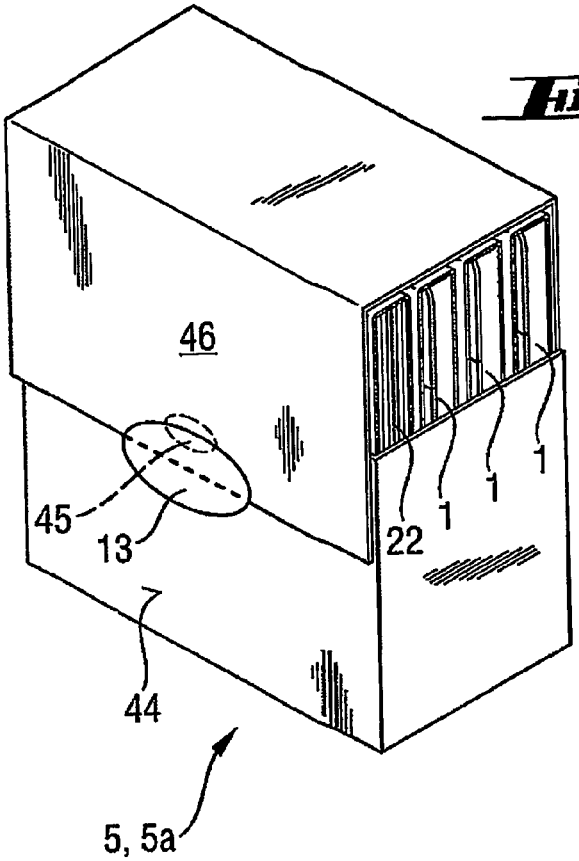
FIGS. 55 through 61 show further embodiments of outer packages, the outer packages illustrated each containing, for example, three blister units and the leaflet with the patient information and directions for use.
Figure 56:
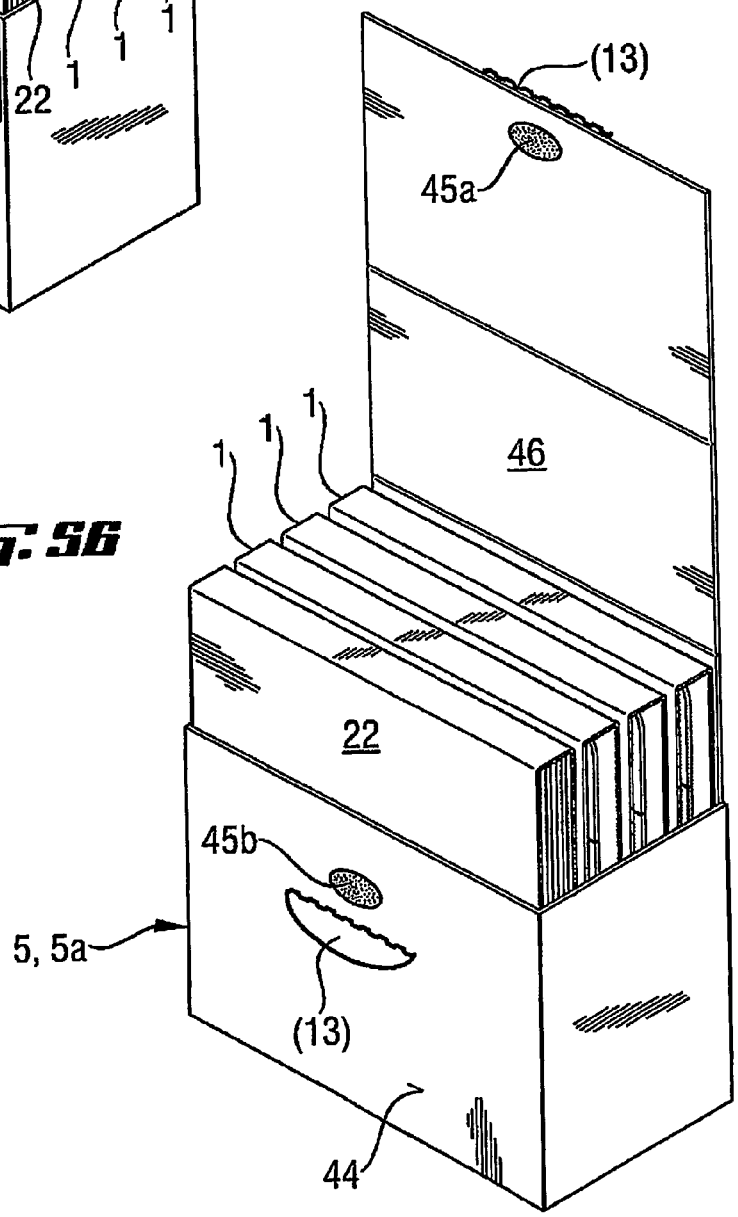
Figure 57:
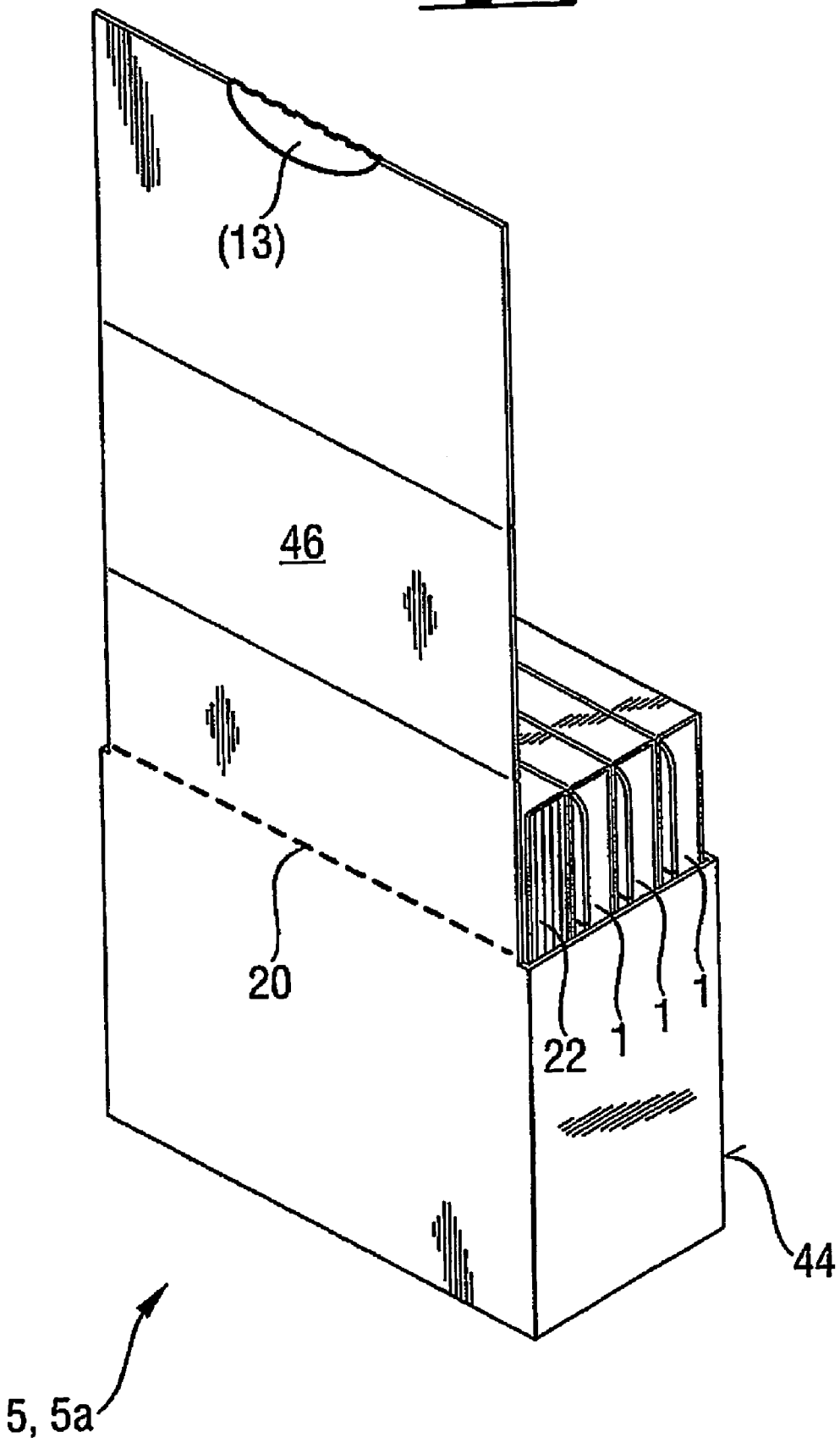

FIGS. 55 through 57 show an embodiment of an outer package 5, namely a base box 5*a*, which is provided with a hinged sleeve 46 and a closure 13 and a contact point 45. FIG. 55 shows the outer package 5 with the hinged sleeve 46 closed, and the contact point 45 which permits reclosure of the hinged sleeve 46 cannot be seen from the outside. When the outer package 5 is first opened, the closure 13 must be opened and, in the case of a tamperproof seal, destroyed. FIG. 56 shows the outer package 5 from FIG. 55 from the front, with the hinged sleeve 46 opened, and it will be seen that the contact point 45 consists of a contact point 45*a* on the hinged sleeve 46 and a matching contact point 45*b* on the side wall 44, and the contact points 45*a* and matching contact point 45*b* come into suitable cooperation with one another upon closure of the hinged sleeve 46 and keep the hinged sleeve 46 closed. FIG. 57 shows an outer package 5 with hinged sleeve 46 in the opened state from behind, where the hinged sleeve 46 in this particular embodiment is connected to the outer package 5 via a perforation 20 and the hinged sleeve 46 can thus be separated, if so desired, from the outer package 5 by tearing along the perforation 20. It should be noted that the perforation 20 for detaching the hinged sleeve 46 is optional. For example, in a comparable way a sealing strap 32 or a hinged lid 5*c* could be applied via a perforation on the outer package 5.

It should be noted that in the case of closure mechanisms such as hinged sleeve 46, sealing strap 32 or hinged lid 5*c*, which can be separated from the outer package 5 via a perforation, as is shown for example in FIG. 57, the outer package 5 is preferably provided with a further non-removable device, for example resilient tabs, which fix the pack content in the inside of the outer package and can secure it against inadvertently slipping out or falling out.

Figure 58:
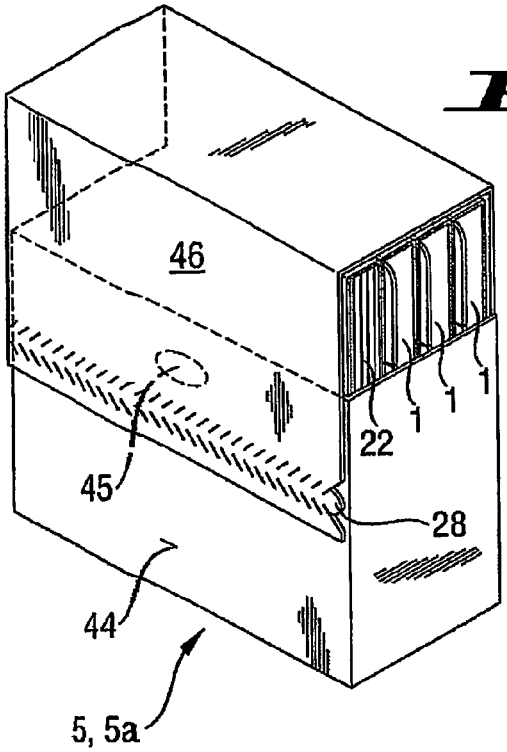
Figure 59:
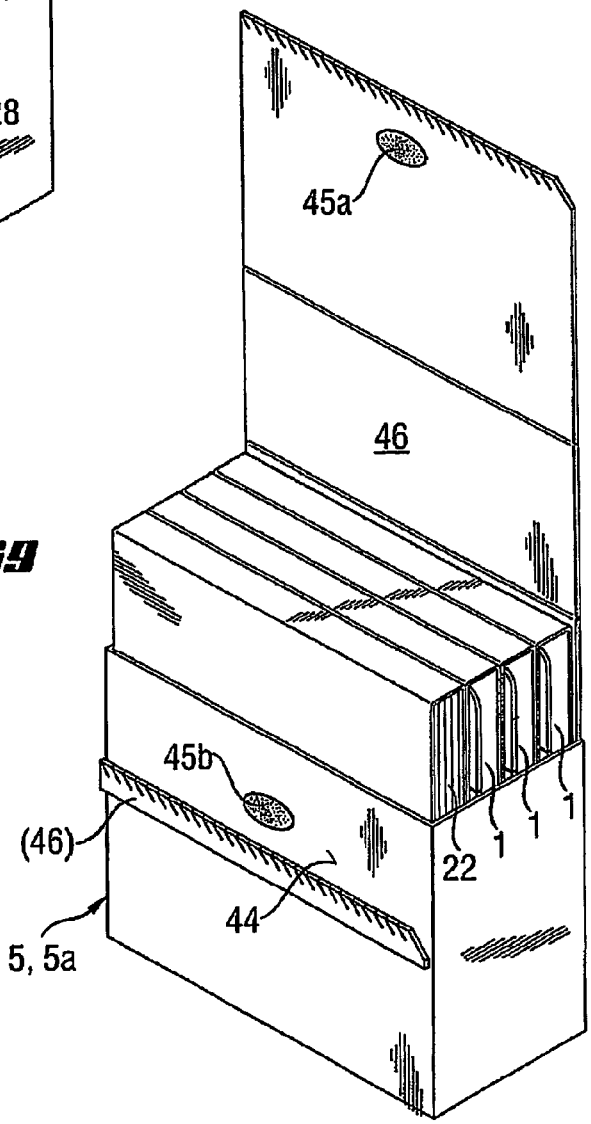

FIG. 58 and FIG. 59 show an embodiment of an outer package 5, namely a base box 5*a* which is provided with a hinged sleeve 46 and with a tear tab 28 and contact point 45, as in FIGS. 55 and 56. FIG. 58 shows the outer package 5 with the hinged sleeve 46 dosed, and the contact point 45 which permits reclosure of the hinged sleeve cannot be seen from the outside. When the outer package 5 is first opened, the tear tab 28 must be torn open and is thus made non-useable for reclosure. FIG. 59 shows a front view of the outer package 5 with the hinged sleeve 46 opened, and it will be seen here that the contact point 45 consists of a contact point 45*a* on the hinged sleeve 46 and of a matching contact point 45*b* on the side wall 44, and, upon closure of the hinged sleeve 46, the contact point 45*a* and the matching contact point 45*b* suitably interact with one another and keep this closed.

Figure 60:
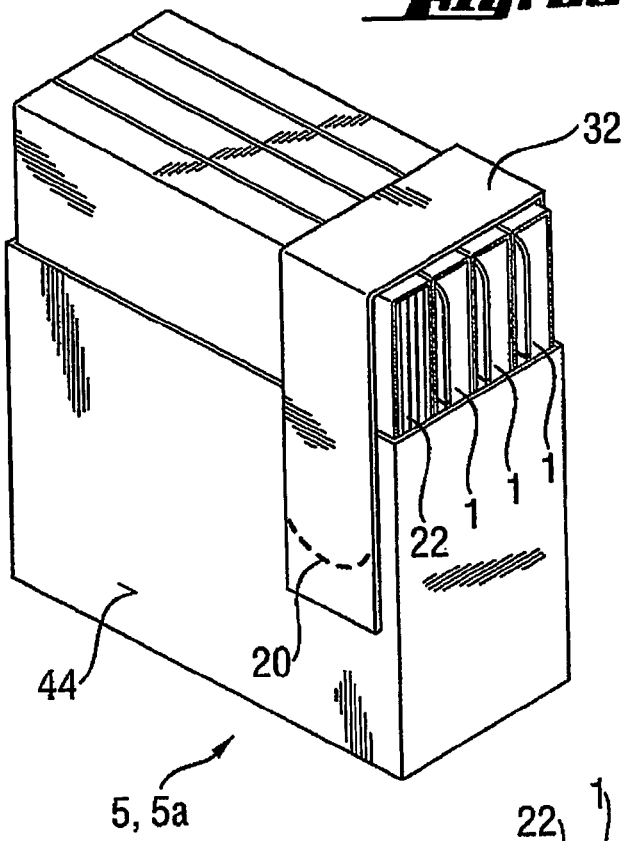
Figure 61:
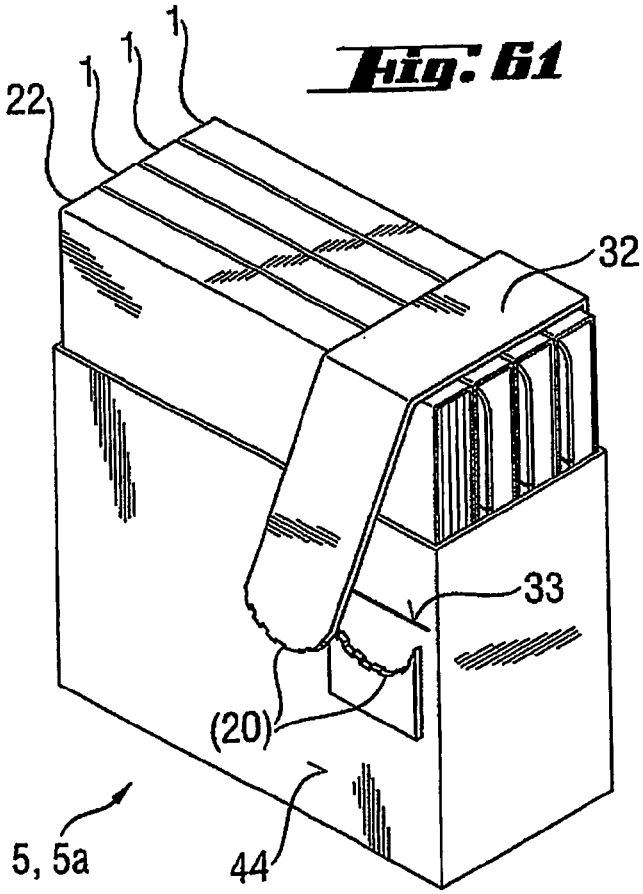

FIG. 60 and FIG. 61 show an embodiment of an outer package 5, namely a base box 5*a* which is provided with a sealing strap 32, where said sealing strap 32, before the outer package 5 is opened for the first time, is fixedly connected to the outer package 5 via a perforation 20. FIG. 60 shows this outer package 5 in the closed state. FIG. 61 shows the outer package 5 from FIG. 60 after the outer package 5 has been opened for the first time by tearing the perforation 20. In this state, the pack content 1 and/or 22 can be removed from the outer package. In order to reclose the outer package 5, the sealing strap 32 in this particular embodiment is inserted into the slit 33 provided for this purpose in the side wall 44.

The medicine pack according to the invention can be used for providing the patient with oral presentations (such as tablets or capsules). The medicine pack according to the invention is suitable both for provision of identical medicaments in each blister cavity and also for therapies in which different medicaments are contained in the individual blister cavities, for example in the context of combination therapy with 2, 3 or more different medicaments. An example which may be mentioned is the provision of medicines for use in treatment of acid-induced disorders of the stomach such as duodenal ulcers, stomach ulcers, moderately severe and severe forms of reflux esophagitis. The medicine packs according to the invention then preferably contain, as active substance, one or more proton pump inhibitors such as pantoprazole, omeprazole, esomeprazole, lansoprazole, rabeprazole and other proton-pump inhibitors known to the skilled person, or one or more active substances from the class of proton pump antagonists, for example soraprazan. However, the medicine pack can also be used, for example, in the treatment of *Helicobacter pylori* diseases, for example in combination therapy of proton pump inhibitors with two suitable antibiotics for eradication of *Helicobacter pylori* in patients with peptic ulcers, with the aim of reducing the incidence of recurrence, induced by this pathogen, of duodenal ulcers and stomach ulcers.

The invention claimed is:

1. A medicine pack, comprising a plurality of blister units, said blister units each having a protective case, with a blister strip located therein, the blister strip being fixedly connected to the protective case, the protective case being able to be unfolded or opened out, and also an outer package for receiving the blister units, the outer package being a base box which is configured in such a way that the pack content can be fixed in the inside of the base box, characterized in that resilient tabs at opposite sides on the inside of the base box are present, which resilient tabs are in each case permanently connected to the base box via at least one common bend/fold edge at the opening of the base box.

2. A medicine pack as claimed in claim 1, wherein the resilient tabs are short resilient tabs, which are connected only to the respective side wall at the opening of the base box.

3. A medicine pack as claimed in claim 1, wherein the base box is further equipped with a device for closing the base box.

4. A medicine pack as claimed in claim 2, wherein the base box is further equipped with a device for closing the base box.

5. A medicine pack as claimed in claim 3, wherein the device for closing the base box is a reclosable hinged lid, hinged sleeve or sealing strap.

6. A medicine pack as claimed in claim 5, where the base box is composed of a base box with a sealing strap, which is fixedly connected to the rear face of the base box via a common edge.

7. A medicine pack as claimed in claim 1, wherein a transparent film encloses the entire medicine pack.

8. A medicine pack as claimed in claim 1, containing a leaflet with the patient information and/or directions for use.

9. A medicine pack as claimed in claim 8, containing 3 or 6 blister units, each blister unit containing one blister strip with 5 blister cavities.

10. A medicine pack as claimed in claim 8, containing 2 or 4 blister units, each blister unit containing one blister strip with 7 blister cavities.

11. A medicine pack as claimed in claim 1, containing as active substance one or more proton pump inhibitors such as pantoprazole, omeprazole, esomeprazole, lansoprazole and rabeprazole.

* * * * *